US011245210B2

(12) United States Patent
Ratkovic et al.

(10) Patent No.: US 11,245,210 B2
(45) Date of Patent: Feb. 8, 2022

(54) HIGH SPEED CONNECTOR SYSTEM

(71) Applicant: Molex, LLC, Lisle, IL (US)

(72) Inventors: Stevan Ratkovic, Maumelle, AR (US); Christopher Roth, Woodridge, IL (US)

(73) Assignee: Molex, LLC, Lisle, IL (US)

( * ) Notice: Subject to any disclaimer, the term of this patent is extended or adjusted under 35 U.S.C. 154(b) by 440 days.

(21) Appl. No.: 15/726,576

(22) Filed: Oct. 6, 2017

(65) Prior Publication Data

US 2018/0287280 A1 Oct. 4, 2018

Related U.S. Application Data

(60) Provisional application No. 62/407,747, filed on Oct. 13, 2016.

(51) Int. Cl.

| | |
|---|---|
| ***H01R 12/72*** | (2011.01) |
| ***H01R 12/70*** | (2011.01) |
| ***H01R 12/62*** | (2011.01) |
| ***H01R 12/59*** | (2011.01) |
| ***H01R 13/6471*** | (2011.01) |
| ***H01R 13/66*** | (2006.01) |

(52) U.S. Cl.

CPC ..... *H01R 12/721* (2013.01); *H01R 12/596* (2013.01); *H01R 12/62* (2013.01); *H01R 12/7005* (2013.01); *H01R 13/6471* (2013.01); *H01R 13/6658* (2013.01)

(58) Field of Classification Search

CPC .... H01R 12/721; H01R 12/596; H01R 12/62; H01R 12/7005; H01R 13/6471; H01R 13/6658; H01R 9/035

See application file for complete search history.

(56) References Cited

U.S. PATENT DOCUMENTS

| | | | | |
|---|---|---|---|---|
| 5,855,493 | A | 1/1999 | Shelly | |
| 7,651,342 | B1 * | 1/2010 | Wu | H01R 9/032 439/607.46 |
| 8,851,905 | B2 * | 10/2014 | Soubh | H01R 24/00 439/76.1 |
| 2010/0210142 | A1 | 8/2010 | McGrath et al. | |

(Continued)

FOREIGN PATENT DOCUMENTS

| | | | |
|---|---|---|---|
| CN | 201181776 | Y | 1/2009 |
| CN | 101814674 | A | 8/2010 |

(Continued)

OTHER PUBLICATIONS

Office Action received for Japanese Patent Application No. 2017-197780, dated Dec. 11, 2018, 8 pages. (4 pages of English Translation and 4 pages of Official Copy).

(Continued)

*Primary Examiner* — Renee S Luebke
*Assistant Examiner* — Paul D Baillargeon

(57) ABSTRACT

A connector system includes a housing with a paddle card. One side of the paddle card includes a plurality of rows of signal terminations. Another side of the paddle card includes a single row of cable terminations. Cable management members may be used to support the rows of signal terminations. A shield member may be used to improve the electrical performance of the signal terminations.

31 Claims, 25 Drawing Sheets

(56) References Cited

U.S. PATENT DOCUMENTS

| | | | | |
|---|---|---|---|---|
| 2012/0052699 | A1* | 3/2012 | MacDougall | H01R 9/035 439/55 |
| 2012/0258612 | A1 | 10/2012 | Nichols et al. | |
| 2012/0285723 | A1 | 11/2012 | Gundel et al. | |
| 2014/0191457 | A1* | 7/2014 | Sharma | H05K 3/301 269/37 |
| 2015/0126067 | A1 | 5/2015 | Zieder | |
| 2015/0318642 | A1 | 11/2015 | Lee et al. | |

FOREIGN PATENT DOCUMENTS

| | | | |
|---|---|---|---|
| CN | 207691046 | U | 8/2018 |
| JP | H10-255925 | A | 9/1998 |
| JP | 2006-32208 | A | 2/2006 |
| JP | 2011-082042 | A | 4/2011 |
| JP | 2011-165557 | A | 8/2011 |
| JP | 2010/070853 | A1 | 5/2012 |
| JP | 2013-80628 | A | 5/2013 |
| JP | 2014-102905 | A | 6/2014 |
| JP | 2014-132588 | A | 7/2014 |
| JP | 2015-167136 | A | 9/2015 |
| JP | 2016-529664 | A | 9/2016 |
| WO | 97/12428 | A1 | 4/1997 |

OTHER PUBLICATIONS

Office Action received for Japanese Patent Application No. 2017-197780, dated Jul. 9, 2019, 8 pages. (4 pages of English Translation and 4 pages of Official Copy).

Decision to Grant received for JP application No. 2017-197780, dated Mar. 17, 2020, 5 pages. (2 pages of English translation and 3 pages of original copy).

Office Action received for JP Application No. 2020-070712, dated Jun. 8, 2021, 07 Pages (04 Pages of English Translation and 03 Pages of Official notification).

* cited by examiner

HIGH SPEED CONNECTOR SYSTEM

RELATED APPLICATIONS

This patent application claims the benefit of priority to U.S. Provisional Patent Application No. 62/407,747, filed Oct. 13, 2016, which is incorporated herein by reference.

TECHNICAL FIELD

This disclosure relates to the field of input/output (IO) connectors, more specifically to IO connectors suitable for use in high data rate applications.

DESCRIPTION OF RELATED ART

Input/output connectors are commonly used in applications where high bandwidth is desired. For example, small form factor pluggable (SFP) style connectors were originally developed to provide a transmit and a receive channel (e.g., to prove what is known as a 1× connector) and gradually the performance of SFP connectors has increased so that they can support 16 Gbps and even 25 Gbps channels. A 1× connector was quickly determined to be insufficient for certain needs and quad small form factor pluggable (QSFP) style connectors were developed to provide more channels and act as a 4× connector.

While larger sizes of connectors have been developed (such as a 10× connector compliant with INFINBAND standards), QSFP style connectors have remained popular due to their size. QSFP connectors have a 0.8 mm pitch that is compatible with a wide range of manufacturing processes and the space provided in a QSFP plug housing allows sufficient space for conventional passive cable termination and even allows for incorporation of active electrical or optical transceiver modules (both of which are increasing desirable as data rates increase). Certain individuals, however, would appreciate further improvements to the design of such pluggable connectors.

SUMMARY

In one aspect, a plug assembly includes a housing configured for mating along a mating axis, a paddle card and a plurality of cables. The paddle card is mounted in the housing and has a first side and a second side opposite the first side, and a first mating end and a second end opposite the first mating end. The paddle card includes a plurality of conductive mating pads adjacent the first mating end, and a plurality of cable termination pads. The plurality of cable termination pads are configured in a first set of rows on the first side of the paddle card and only a single row on the second side of the paddle card, with the cable termination pads of each row including signal termination pads and ground termination pads. A first number of rows of cable termination pads on the first side is at least double a second number of rows of cable termination pads on the second side. Each cable includes a signal conductor and each signal conductor is terminated to one of the signal termination pads.

In another aspect, a method of assembling a plug connector includes a) providing a housing configured for mating along a mating axis and b) providing a paddle card having a first side, a first mating end, and a second end opposite the first mating end. The paddle card includes a plurality of conductive mating pads adjacent the first mating end, and a plurality of cable termination pads, with the plurality of cable termination pads being configured in a first row of cable termination pads along the first side adjacent the second end of the paddle card, and at least one additional row of cable termination pads spaced from the first row of cable termination pads and spaced from the mating pads. The first row of cable termination pads and the additional row of cable termination pads include signal termination pads and ground termination pads. The method further includes c) providing a plurality of cables, with each cable including a signal conductor, d) terminating each signal conductor of a first set of the cables to one of the signal termination pads of the first row of cable termination pads to define a first signal termination, and e) mounting a first shield member on the paddle card including mounting a conductive first shielding projection between adjacent first signal terminations and electrically connecting each first shielding projection to one of the ground termination pads of the first row. The method also includes f) after completing steps d) and e), terminating each signal conductor of a second set of the cables to one of the signal termination pads of the second row of cable termination pads to define a second signal termination, g) mounting a second shield member on the paddle card including mounting a conductive second shielding projection between adjacent second signal terminations and electrically connecting each second shielding projection to one of the ground termination pads of the second row, and h) mounting the paddle card and cables within the housing.

In still another aspect, a plug assembly includes a housing configured for mating along a mating axis, a paddle card, a plurality of cables, and a plurality of conductive shielding projections. The paddle card is mounted in the housing and has a first mating end and a second end opposite the first mating end. The paddle card includes a plurality of conductive mating pads adjacent the first mating end, and a plurality of cable termination pads disposed in a row, with the row of cable termination pads including signal termination pads and ground termination pads. The plurality of cables includes a signal conductor with each signal conductor being terminated to one of the signal termination pads to define a signal termination. The plurality of conductive shielding projections are disposed on the paddle card, with each shielding projection being disposed between adjacent signal terminations and being electrically connected to one of the ground termination pads.

In a further aspect, a plug assembly includes a housing configured for mating along a mating axis, a paddle card, a plurality of cables, and a cable management member. The paddle card is mounted in the housing and has a first mating end and a second end opposite the first mating end. The paddle card includes a plurality of conductive mating pads adjacent the first mating end, and a plurality of cable termination pads disposed in a row, with the row of cable termination pads including signal termination pads and ground termination pads. The plurality of cables includes a signal conductor with each signal conductor being terminated to one of the signal termination pads to define a signal termination. The cable management member is disposed on the paddle card adjacent the row of cable termination pads, and the cable management member includes a plurality of openings with one of the cables disposed in each opening.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
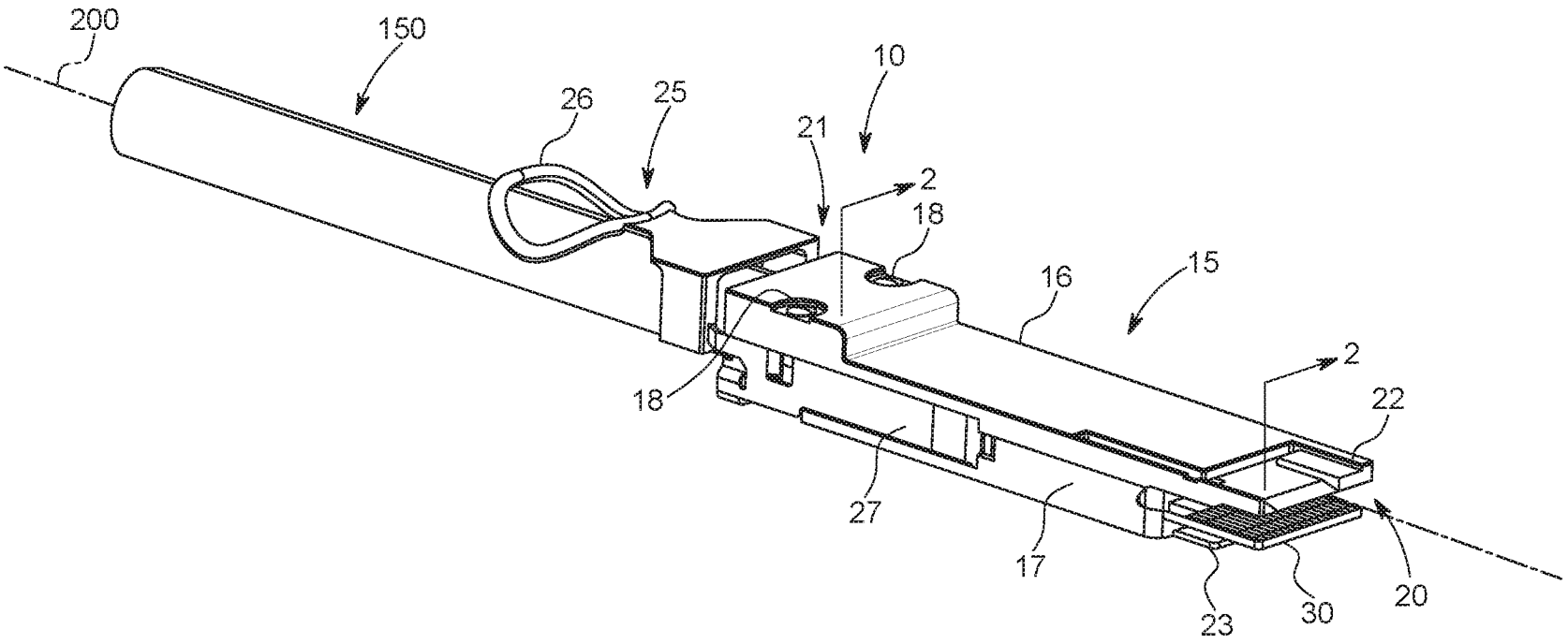
FIG. 1 illustrates a perspective view of a plug connector according to the disclosure.
Figure 2:
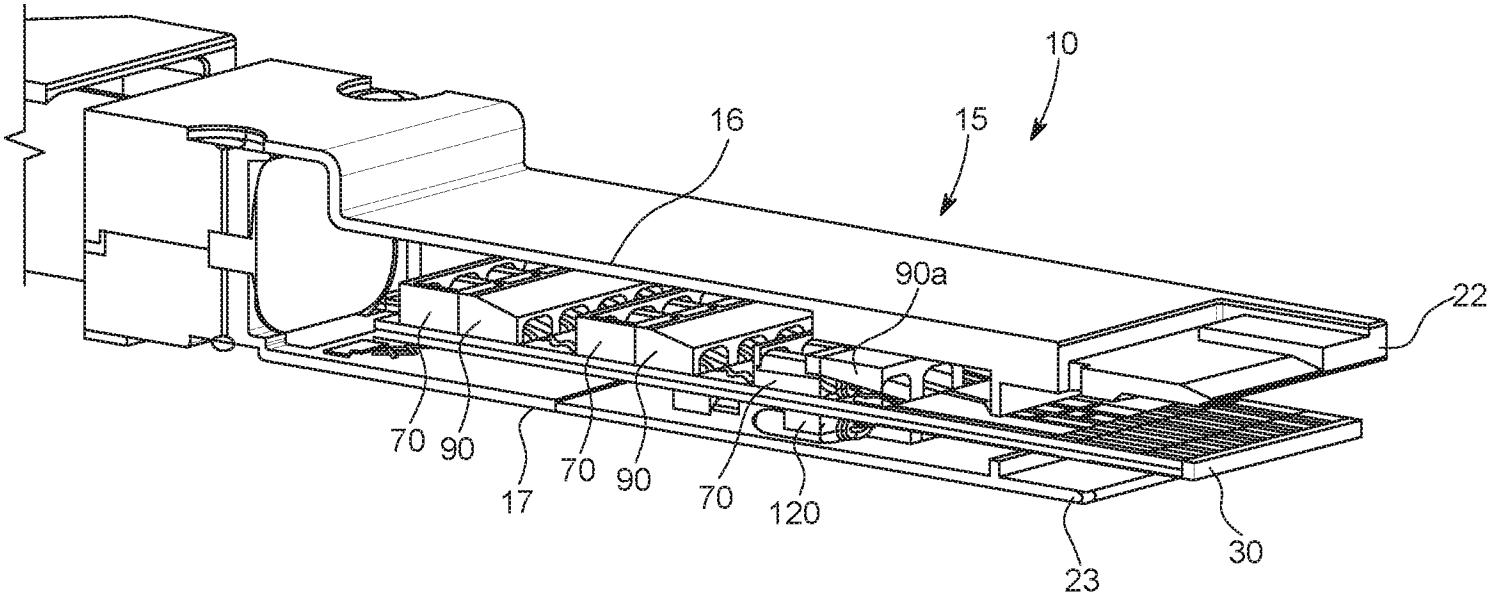
FIG. 2 illustrates an enlarged sectional view taken generally along the lines 2-2 in FIG. 1.

The detailed description that follows describes exemplary embodiments and the features disclosed are not intended to be limited to the expressly disclosed combination(s). Therefore, unless otherwise noted, features disclosed herein may be combined together to form additional combinations that were not otherwise shown for purposes of brevity.

Referring to FIGS. 1-5, a plug connector 10 is disclosed. The plug connector 10 includes a housing 15 with a circuit board or paddle card 30 disposed therein, and a plurality of cables 150 terminated to the paddle card.

The housing 15 is depicted as a two-piece structure with an upper housing component 16 and a lower housing component 17. The housing 15 has a leading or mating end 20 and a rear end 21 opposite the mating end. The upper housing component 16 has an upper cantilevered section 22 adjacent the mating end 20 and the lower housing component 17 has a lower cantilevered section 23 also adjacent the mating end. In one embodiment, the upper cantilevered section 22 extends farther than the lower cantilevered section 23. The upper end lower housing components 16, 17 may be secured together in any desired manner, such as with fasteners 18 positioned generally adjacent the rear end 21.

The housing 15 may be formed in any desired manner and of any desired materials. As examples, the upper and lower housing components 16, 17 may be die cast, machined, or molded. The upper and lower housing components 16, 17 may be formed of metal, plastic, or any other desired material. If desired, the upper and lower housing components 16, 17 may be conductive such as by forming the components of metal or by forming the components of plastic and applying plating as desired.

Plug connector 10 may also include a latching structure 25 for locking and unlocking the plug connector 10 from a mating receptacle (not shown). The latching structure includes a manually graspable release member 26 operatively connected to a pair of latch arms 27. Longitudinal movement of the release member 26 along the mating axis 200 away from the mating end 20 causes movement of the latch arms 27 to disengage the latch arms from the mating receptacle.

Figure 3:
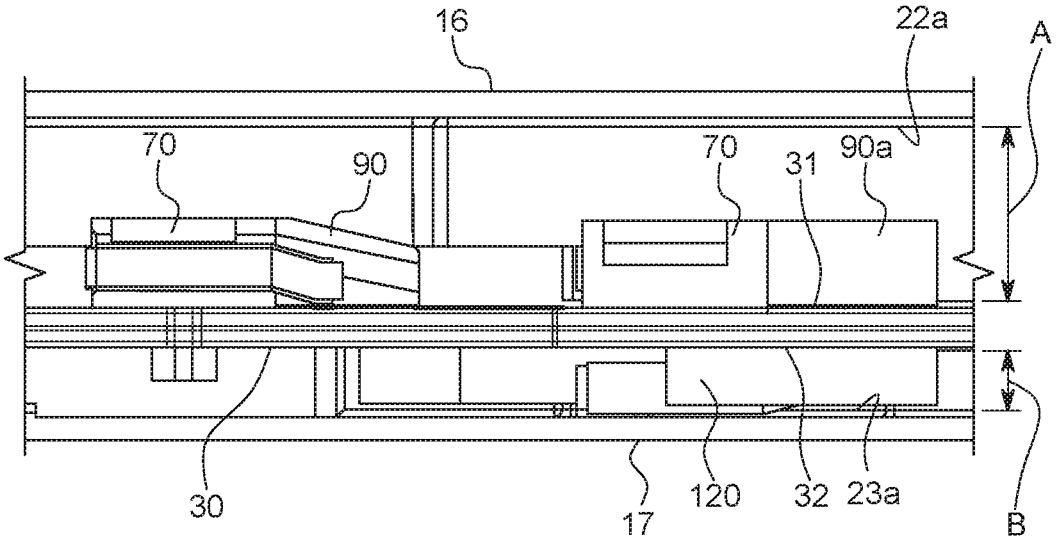
FIG. 3 illustrates an enlarged side view of a portion of FIG. 2.

The circuit board or paddle card 30 is disposed within the housing 15. In one embodiment, the paddle card 30 may be positioned within the housing 15 in an offset manner towards the bottom wall 17 of the housing such that the distance "A" (FIG. 3) between the upper surface 31 of the paddle card and the upper cantilevered section depicted at 22*a* FIG. 3 is at least two times distance "B" between the lower surface 32 of the paddle card and the lower cantilevered section depicted at 23*a* in FIG. 3.

Figure 10:
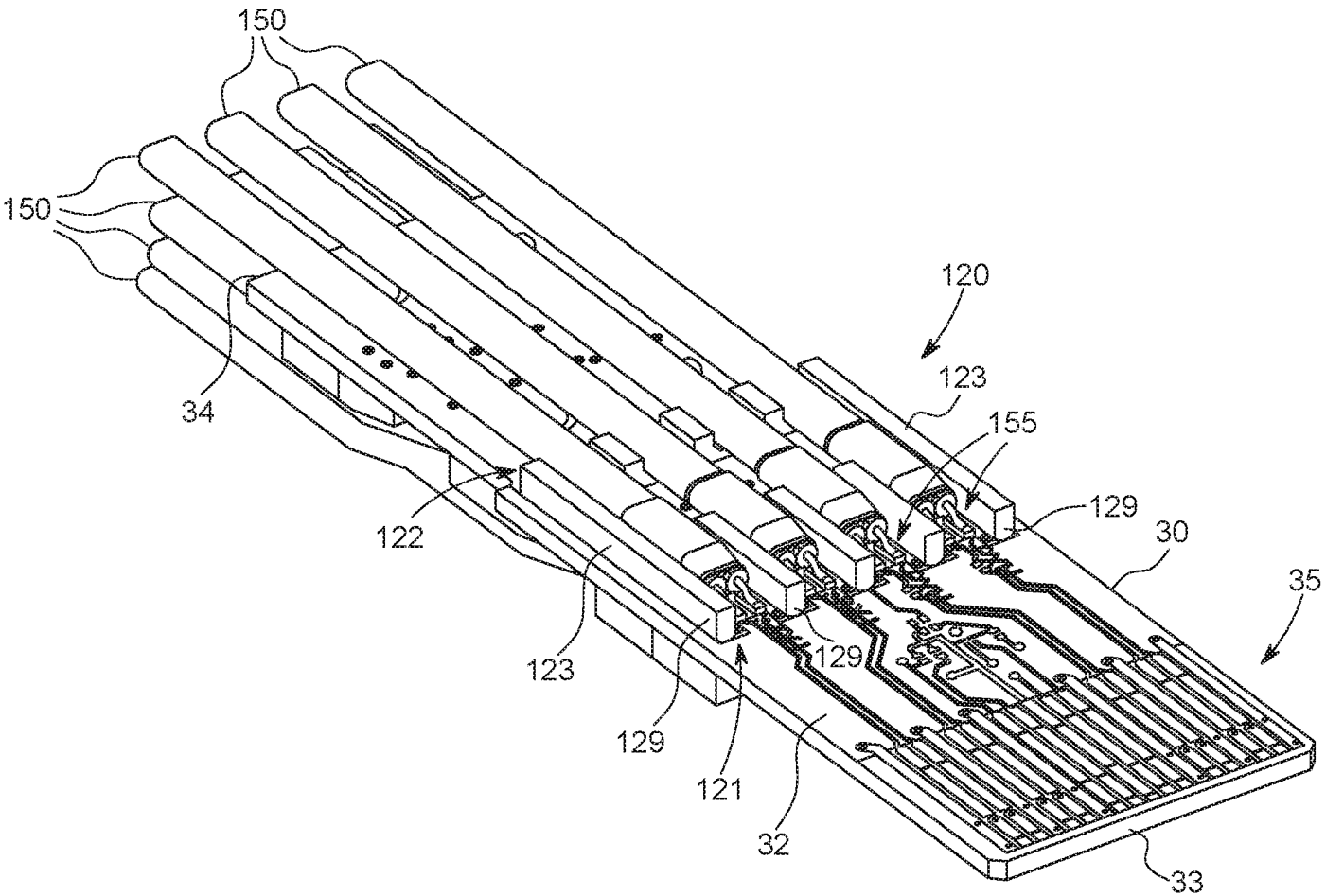
FIG. 10 illustrates a perspective view of the paddle card and components mounted thereon of FIG. 6 with the assembly rotated to depicted the bottom of the paddle card.
Figure 11:
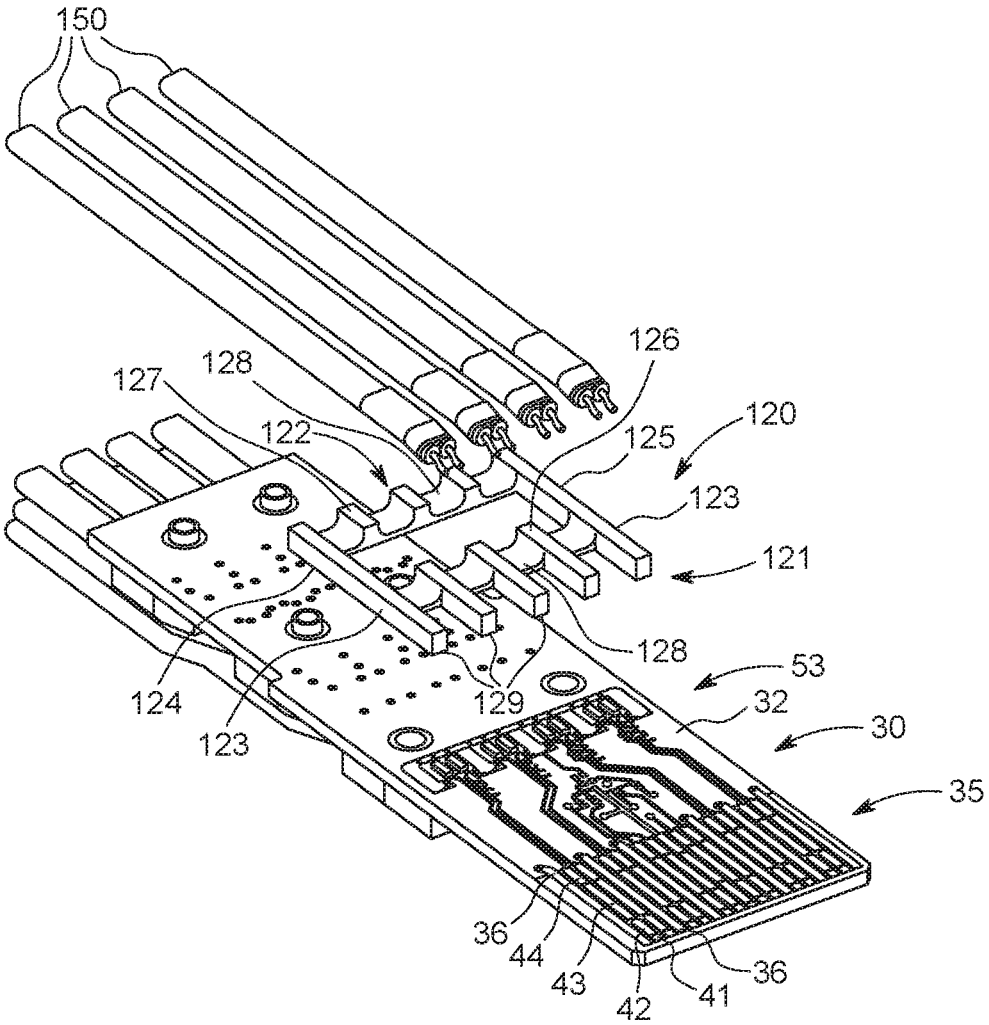
FIG. 11 illustrates an exploded perspective view of FIG. 10.
Figure 12:
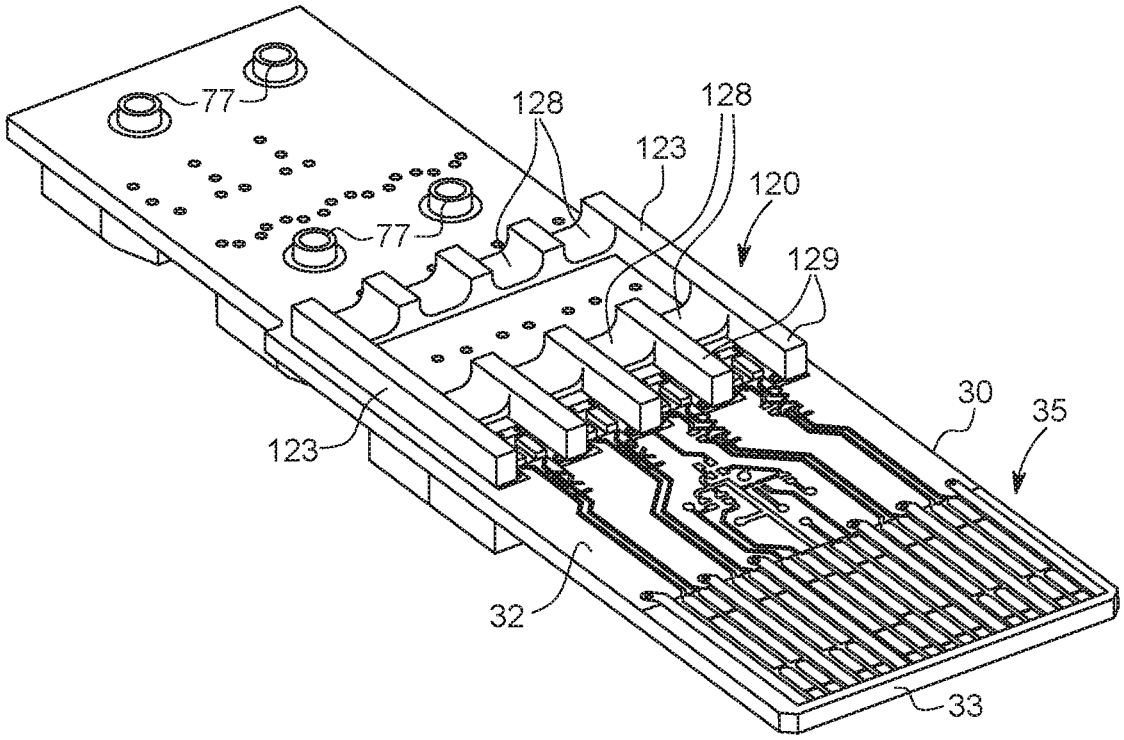
FIG. 12 illustrates a perspective view similar to FIG. 10 but with the cables removed for clarity.
Figure 13:
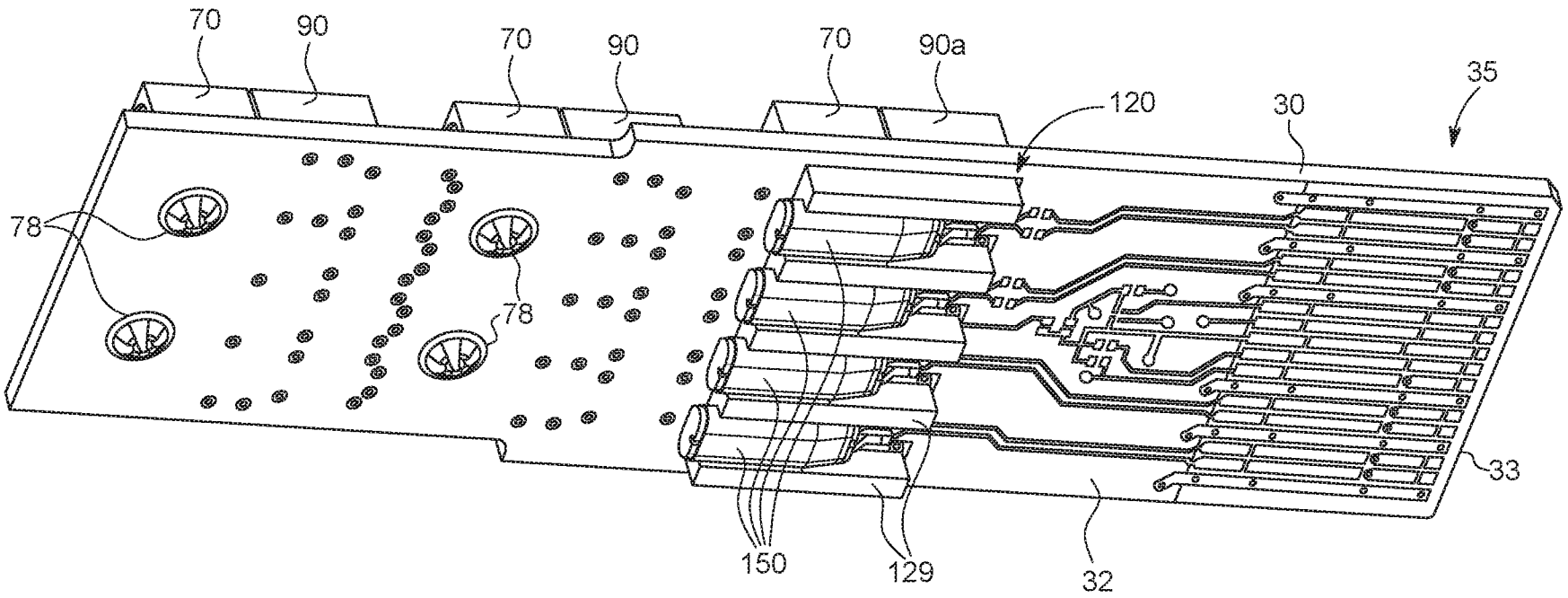
FIG. 13 illustrates a perspective view similar to FIG. 10 but with portions of the cables removed for clarity and with the components illustrated from a different perspective.
Figure 14:
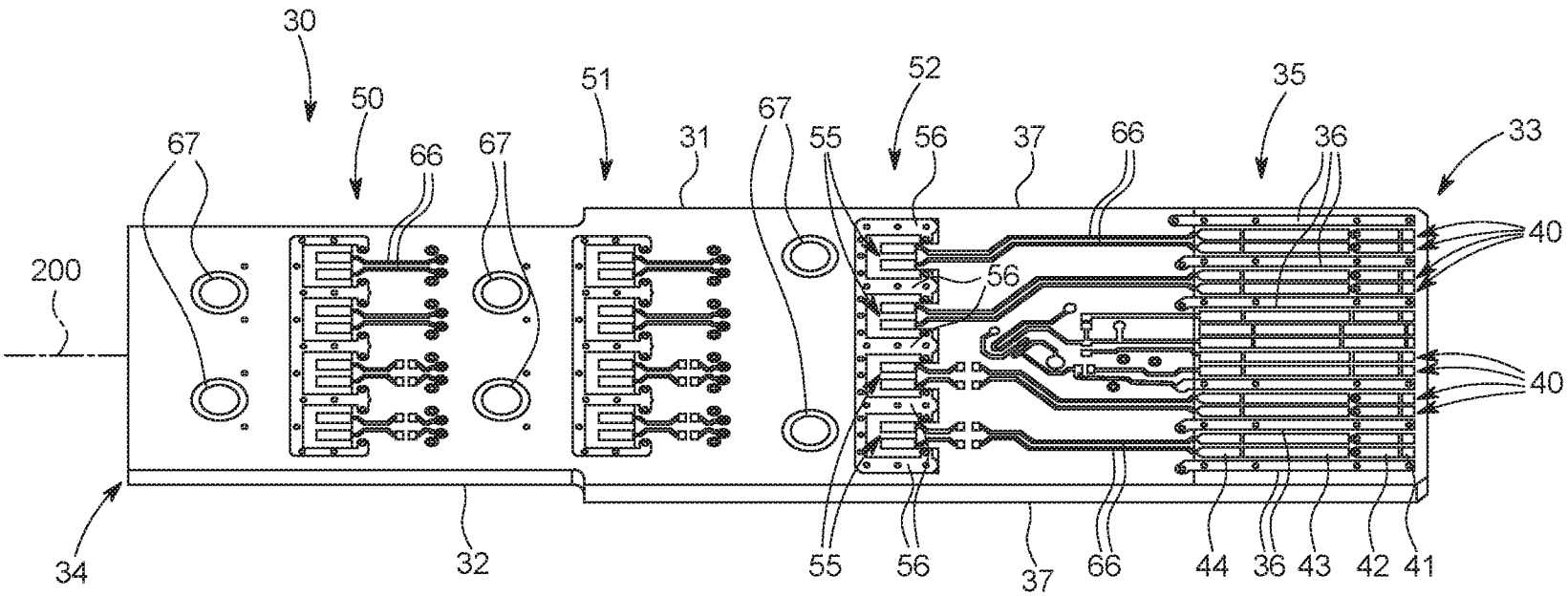
FIG. 14 illustrates a perspective view of a paddle card according to the disclosure.
Figure 15:
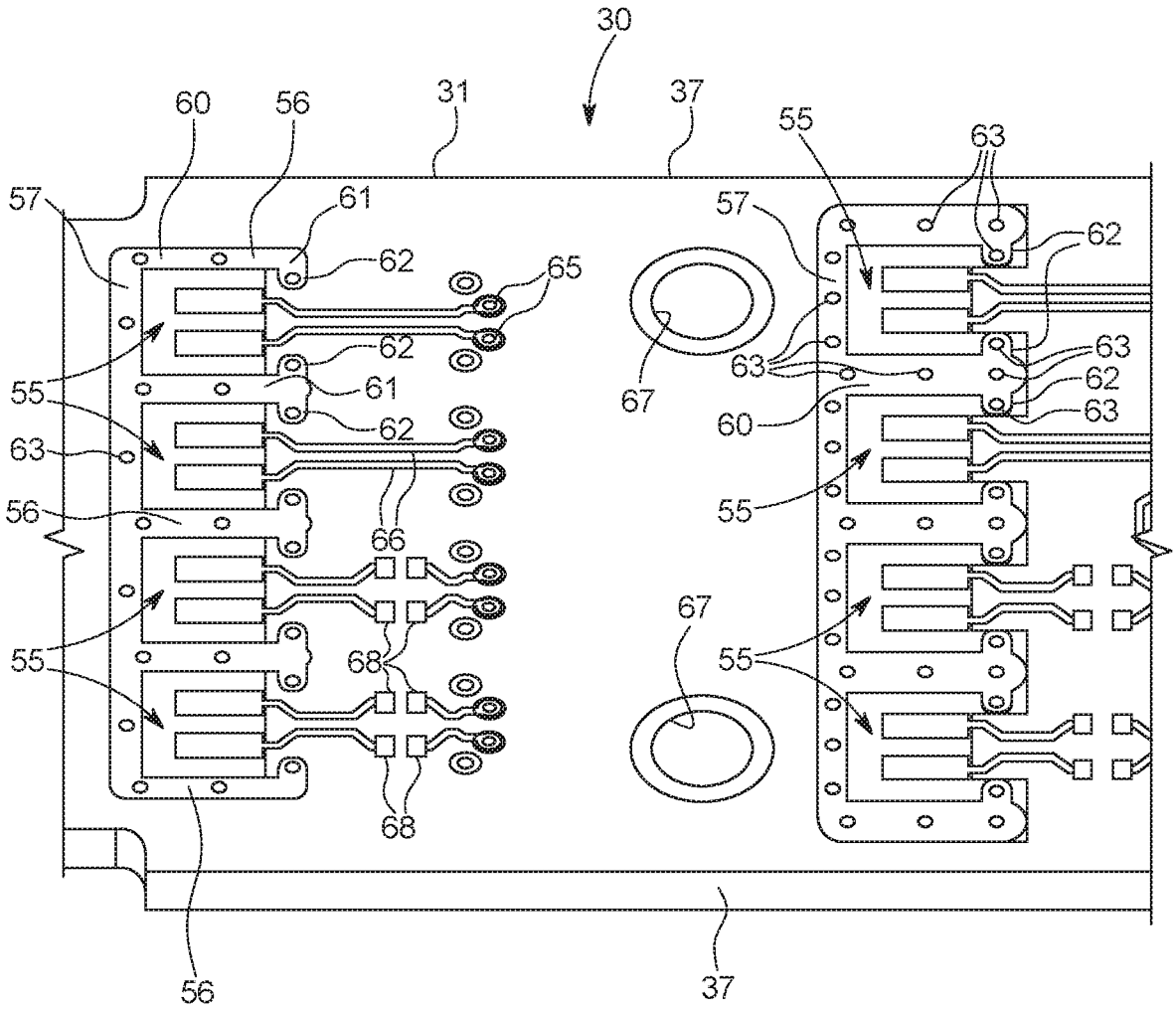
FIG. 15 illustrates an enlarged, fragmented portion of FIG. 14.

Referring to FIGS. 14-15, the paddle card 30 has a mating end 33 and a rear end 34, opposite the mating end. The paddle card 30 has a plurality of conductive mating pads 35 that extend parallel to the mating axis 200 on both the upper surface 31 and the lower surface 32 (FIGS. 10-12) adjacent the mating end 33. As depicted, the plurality of mating pads include a plurality of laterally spaced apart (relative to the mating axis 200) elongated pads 36 that may be configured as ground or referenced pads.

A plurality of sets 40 of shorter (along or parallel to the mating axis 200) conductive pads are positioned laterally between the elongated pads 36. As depicted, each set 40 of conductive mating pads includes, sequentially from the mating end 33 towards the rear end 34, a first relatively short pad 41, a second medium length pad 42, a relatively long third pad 43, and a fourth medium length pad 44. In the depicted embodiment, most or all of the second and fourth medium length pads 42, 44 may be electrically connected to circuits of or components on the paddle card 30. The first pads 41 and the third pads 43 may not be electrically connected to circuits of or components on the paddle card 30 and may operate as a relatively smooth surface along which a terminal (not shown) of the mating receptacle (not shown) may slide during the mating process.

The paddle card 30 has three rows 50-52 of conductive cable termination pads on the upper surface 31 and one row 53 (FIG. 11) of the cable termination pads on the lower surface 32. Each of the cable termination pads is elongated along or relative to the mating axis 200. On the upper surface 31, a first row 50 of cable termination pads is positioned generally adjacent the rear end 34 and the other two rows 51-52 are positioned between the first row and the conductive mating pads 35 adjacent the mating end 33. On the lower surface 32, the row 53 of cable termination pads is positioned generally below the row 52 on the upper surface 31 closest to the mating pads 35.

As depicted, each row 50-53 of cable termination pads includes four pairs of signal termination pads 55. The paddle card 30 may be configured so that each pair of signal termination pads 55 operates as a differential pair. Each pair of signal termination pads 55 is spaced from an adjacent pair with a ground termination pad 56 disposed between the adjacent pairs. A ground termination pad 56 may also be disposed between the pairs of outermost signal termination pads 55 and the outer edges 37 of the paddle card 30. Through such a configuration, each pair of signal termination pads 55 includes a ground termination pad 56 on opposite lateral sides thereof.

If desired, a conductive bridging member 57 may extend along one end 60 of each ground termination pad 56 to interconnect each of the ground termination pads. As can be appreciated, each pair of signal termination pads 55 is thus surrounded by a U-shaped ground trace. A lateral tab 62 may extend laterally from the opposite end 61 of each ground termination pad 56. Through the use of the ground structure including the ground termination pads 56, the conductive bridging member 57, the lateral tabs 62, and the positioning of ground vias 63, improved electrical performance may be achieved. More specifically, the configuration of the ground structure shortens the path between ground connections to reduce resonance within the system by increasing the frequency of any possible resonance that may exist above the operating frequencies of the system in which the plug connector 10 is operating.

Paddle card 30 may be formed in any desired manner including utilizing conventional circuit board manufacturing processes. In one embodiment, paddle card 30 may have eight conductive layers including ground, signal, and mixed layers. The mating pads 35 and the cable termination pads 50-53, 55-56 may be electrically connected along any of the conductive layers with conductive traces (such as traces 66 on upper surface 31) and between layers through the use of conductive vias 63, 65 as is known in the art. Various components (not shown), such as capacitors, may be mounted on the paddle card 30 at component mounting pads 68. Mounting holes or bores 67 may extend through the paddle card 30 for mounting components on the paddle card as described in further detail below. As depicted, the mounting holes 67 are plated through holes and are mechanically and electrically connected to one or more ground layer within the paddle card 30.

As depicted in the drawings, a plurality of cables 150 are terminated to the paddle card 30. In the depicted embodiment, each cable 150 is configured as a twinax cable with a pair of signal conductors 151. Each signal conductor 151 is surrounded by an insulator 152 and the insulators 152 are surrounded by a ground or shielding layer 153, and the shielding layer surrounded by an outer insulative layer 154. Each of the signal conductors 151 is terminated to one of the signal termination pads 55, such as by soldering or in any other desired manner, to form a signal termination 155.

Figure 17:
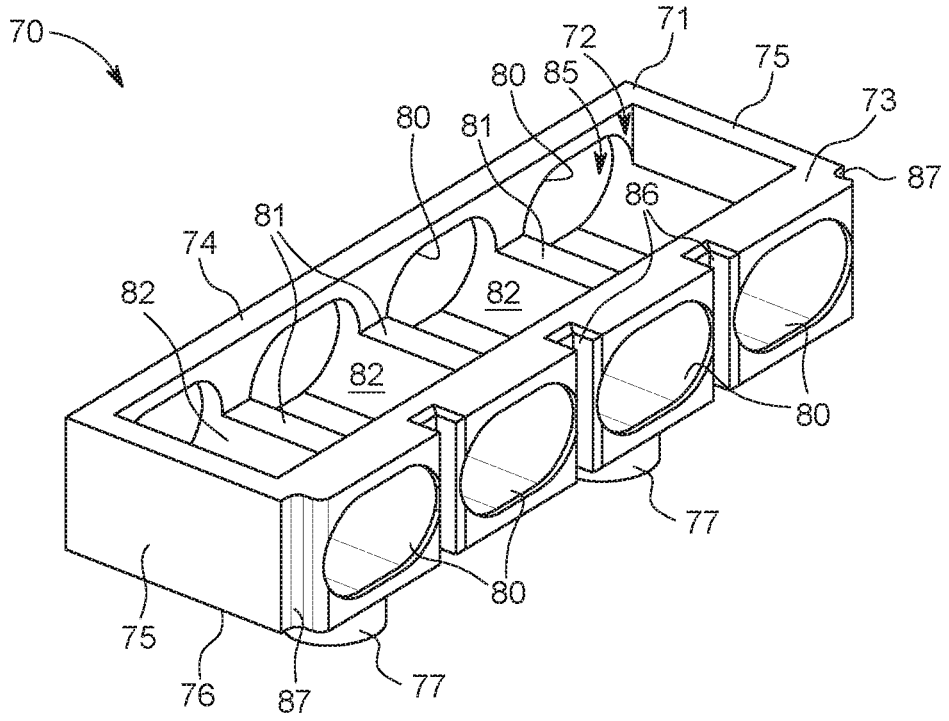
FIG. 17 is a perspective view of a cable management member according to the disclosure.
Figure 18:
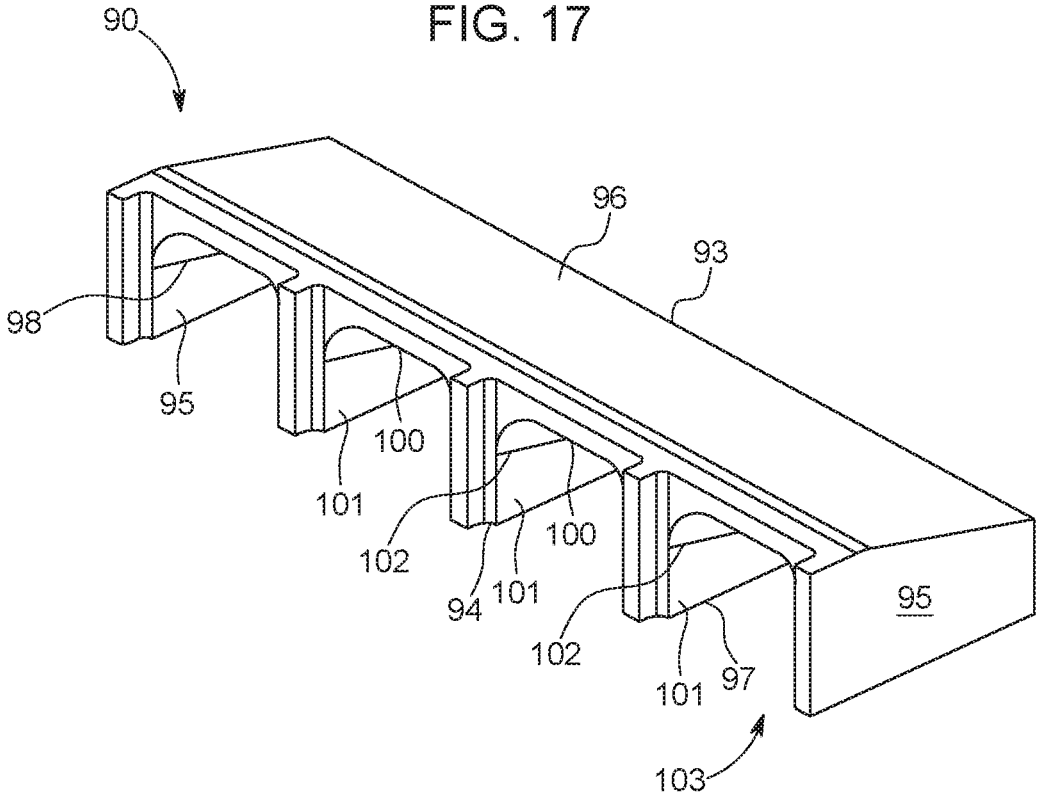
FIG. 18 is a perspective view of a shield member according to the disclosure.
Figure 19:
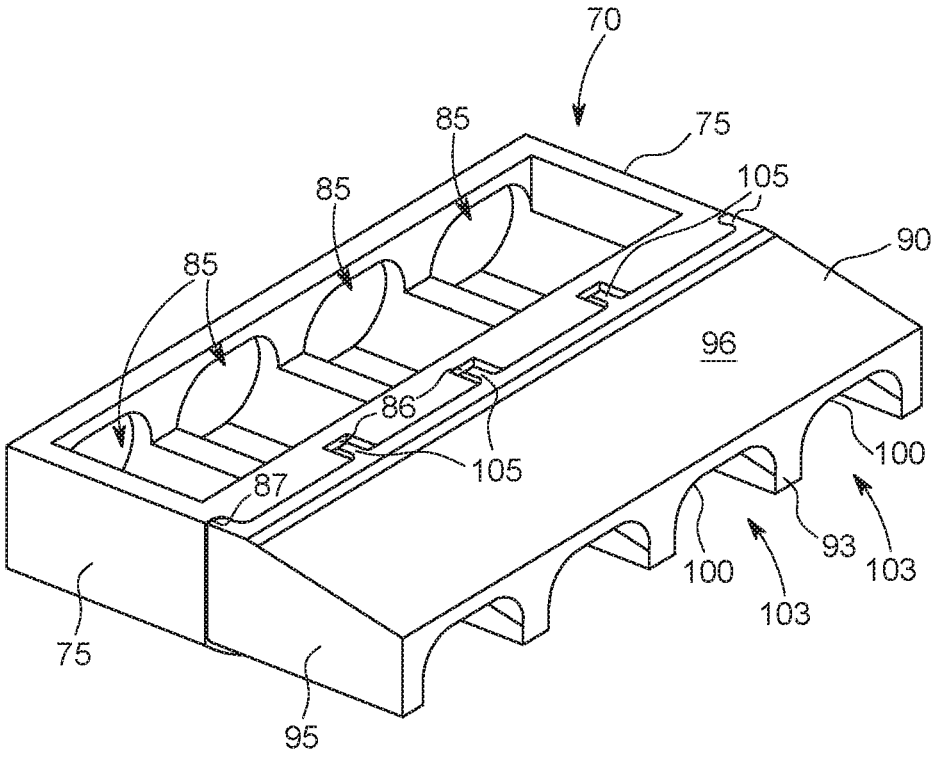
FIG. 19 is a perspective view of the cable management member of FIG. 17 connected to the shield member of FIG. 18.
Figure 20:
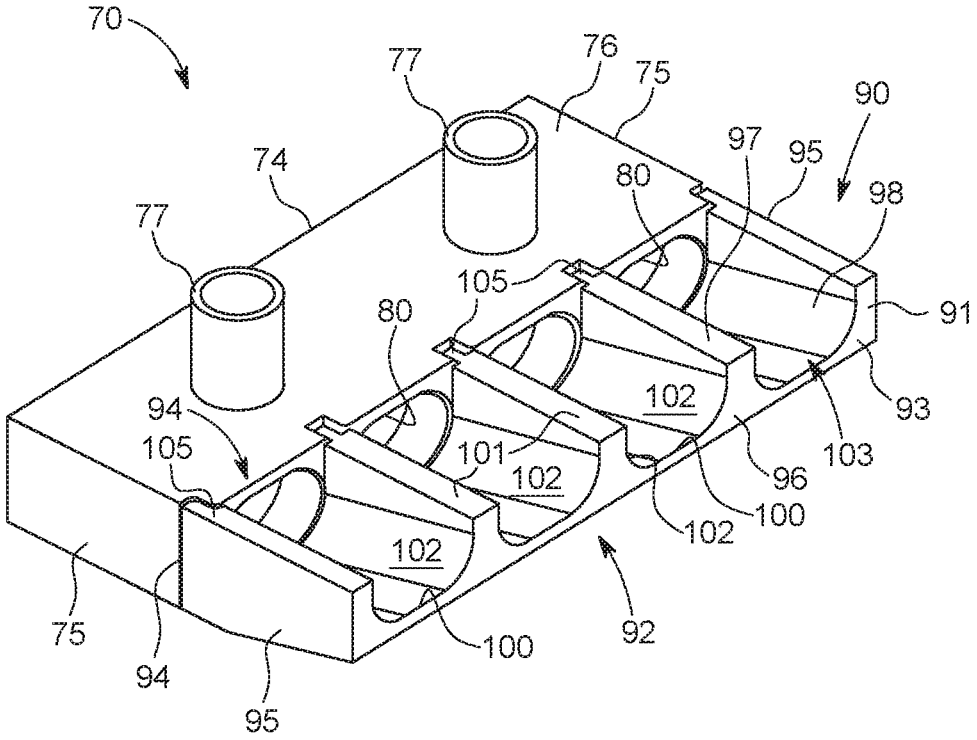
FIG. 20 is a perspective view similar to FIG. 19 but from a different perspective showing the bottom of the assembly.

The cables 150 terminated to the upper surface 31 of the paddle card 30 are secured to the paddle card through the use of a plurality of a plurality of cable management members 70 (FIGS. 17-19). As depicted in FIGS. 6-9, one cable management member 70 is provided to assist in terminating each row 50-52 of cable termination pads. Each cable management member 70 is generally rectangularly shaped to form a cuboid body 71 with an open central section or cavity 72. The body 71 includes a front wall 73, a rear wall 74 opposite the front wall, sidewalls 75 that interconnect the front wall and the rear wall, and a lower or mounting wall 76. A pair of hollow mounting projections 77 extending downwardly from the mounting wall 76. A plurality of openings 80 configured as oval-shaped bores extend through the front wall 73 and the rear wall 74. Each opening 80 in the front wall 73 is aligned with one of the openings in the rear wall 74 to form pairs of openings that are parallel to the mating axis 200. The shape of the openings 80 may be configured to generally match the cross-section of the cables 150.

Central projections 81 extend upward from the lower wall 76 within the central cavity 72 and each may be configured with oppositely facing arcuate side surfaces 82. A portion of each sidewall may also have an inwardly facing arcuate side surface 84. A channel 85 having arcuate sidewalls is defined by a pair of opposed side surfaces 82, 84 with each side surface configured to generally match the cross-section of the cables 150. Each channel 85 extends between and is aligned with one of the pairs of openings 80.

The cable management members 70 may be formed in any desired manner and of any desired materials. As examples, the cable management members 70 may be die cast, machined, or molded. The cable management members 70 may be formed of metal, plastic, or any other desired material. If desired, the cable management members 70 may be conductive such as by forming the components of metal or by forming the member of plastic and applying plating as desired. Although depicted with four pairs of openings 80 and an aligned channel 85, the cable management members 70 may include any desired number of pairs of openings and channels. Further, in some embodiments, the cable management member may include only an opening 80 in the front wall 73 or the rear wall 74 and each of the openings and the channels 85 may not include arcuate sidewalls generally configured to match the cross-section of the cables 150.

As can be appreciated, the cable management members 70 support the cables 150 and provides a measure of strain relief for the signal terminations 155. As depicted, a single cable management member 70 is provided across each entire row 50-52 of termination pads but individual cable management members could also be provided for each cable 150. The benefit of the single cable management member 70 is increased robustness and strength as well as fewer parts to handle. To improve retention of the cables 150, potting material can be used to secure each cable 150 to the cable management member 70.

To mount a cable management member 70 on the paddle card 30, cables 150 may first be inserted into the cable management member and the assembly of the cable management member and the cables positioned above the paddle card so that the mounting projections 77 are aligned with the mounting holes 67 in the paddle card. The assembly of the cable management member 70 and the cables 150 are then moved relative to the paddle card 30 so that the mounting projections 77 are inserted into the mounting holes 67. A fastener such as a rivet 78 (FIG. 11) may be inserted into each mounting projection 77 and secured to the paddle card 30. If the mounting holes 67 and the cable management member 70, including the mounting projections 77, are conductive, an electrical connection may be formed through contact between the mounting holes and the mounting projections and/or through the rivets 78.

Figure 16:
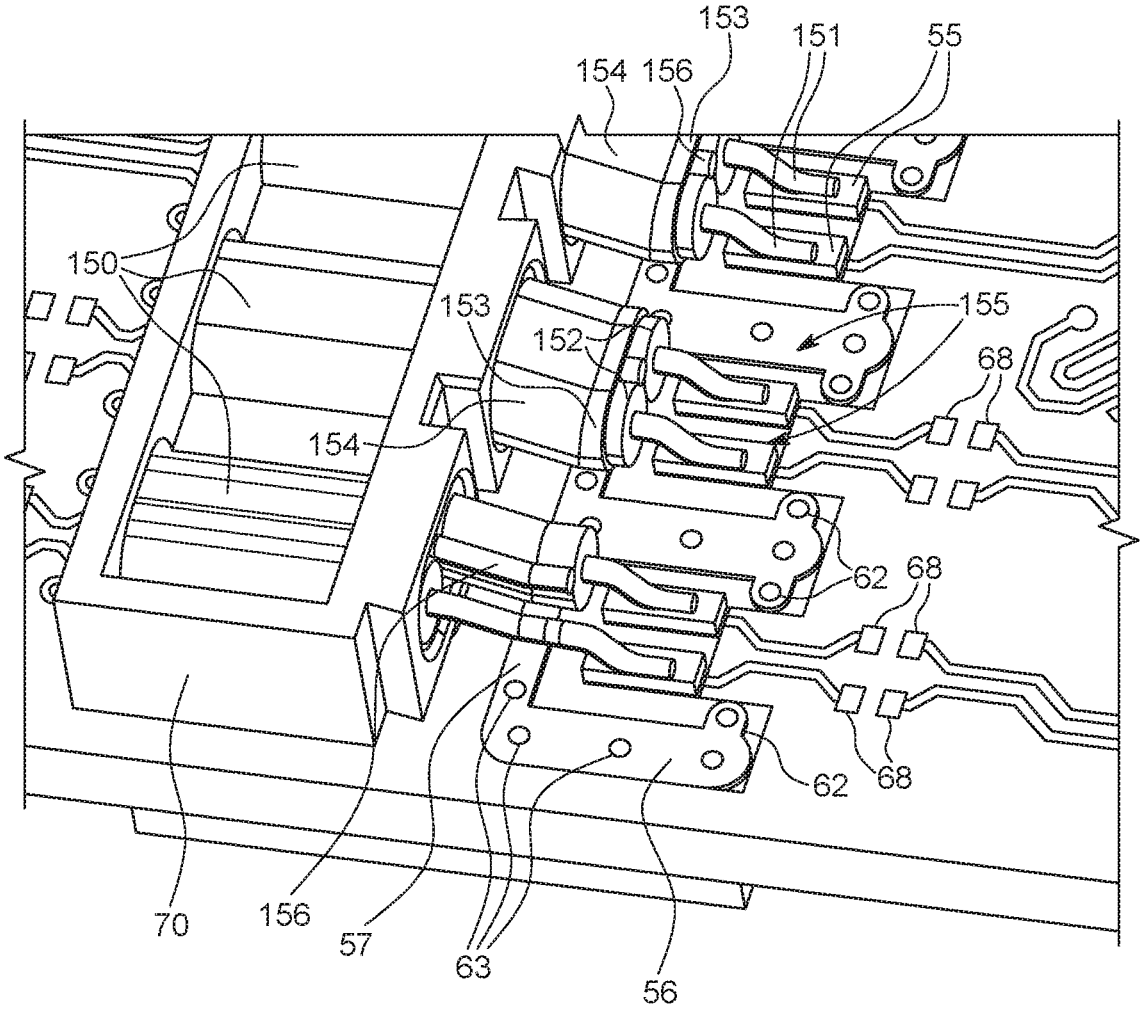
FIG. 16 illustrates an enlarged, perspective view of a portion of a cable management member together with a plurality of signal conductors terminated to signal termination pads with portions of cables removed for clarity.

As best seen in FIG. 16, upon preparing (e.g., stripping) the ends of the cables 150 to expose the signal conductors 151, the shielding 153 is removed from around the two signal conductors. Accordingly, upon terminating the signal conductors 151 to the signal termination pads 55 to form a signal termination 155, cross-talk from adjacent signal pairs may affect the electrical performance of each signal pair. In addition, other signals or noise from other sources such as the cables 150 that pass over the signal terminations 155 may also have a negative impact on the electrical performance of the signal pairs. Further, because the insulation 12 and shielding 153 have been removed from around the signal pairs, a relatively large impedance discontinuity of the transmission line at the signal termination 155 between the signal termination pads 55 and the signal conductors 151 may also occur.

To improve the electrical performance of the plug connector 10, a shielding member 90 may be disposed over the signal terminations 155. Referring to FIG. 18, the shielding member is shaped to generally form a cuboid body 91 with an open central section or cavity 92. The body 91 includes a front wall 93, a rear wall 94 opposite the front wall, sidewalls 95 that interconnect the front wall and the rear wall, an upper or top wall 96, and a lower or mounting surface 97. The sidewalls 95 may be configured with arcuate inner surfaces 98 that generally match the cross-section of the cables 150. The upper surface of the upper wall 96 may be tapered so that it is lowest adjacent the front wall 93, or it may be flat as depicted with respect to shield member 90*a*.

A plurality of openings 100 configured as portions or segments of oval-shaped bores extend through the front wall 93 and the rear wall 94. Each opening 100 in the front wall 93 is aligned with one of the openings in the rear wall 94 to form pairs of openings that are parallel to the mating axis 200. The shape of the openings 100 may be configured to generally match the cross-section of the cables 150.

Internal walls 101 extend downward from the upper wall 96 into the central cavity 92. The internal walls 101 extend between the front wall 93 and the rear wall 94 and are positioned at a midpoint between the openings 100. The internal walls 101 may each be configured with oppositely facing arcuate side surfaces 102 that generally match the cross-section of cables 150. A channel 103 having arcuate sidewalls is defined by a pair of opposed side surfaces 98, 102 and a pair of aligned openings 100 in the front wall 93 and the rear wall 94.

The shield members 90 may be formed in any desired manner and of any desired materials with at least a portion of the shield members being conductive. As examples, the shield members 90 may be die cast, machined, or molded. The shield members 90 may be formed of metal, plastic, or any other desired material. If formed of a non-conductive material, a conductive material such as plating may be applied to at least a portion of the shield members 90, as desired. Although depicted with four pairs of openings 100 and an aligned channel 103, the shield members 90 may include any desired number of pairs of openings and channels. Further, in some embodiments, each of the openings 100 and the channels 103 may not include arcuate sidewalls generally configured to match the cross-section of the cables 150.

Upon mounting a shield member 90 on the paddle card 30, the lower surface 97 of the shield member will make mechanical and electrical contact with the ground termination pads 56 of the paddle card. As a result of the engagement with a ground termination pad 56, each of the internal walls 101 of the shield member 90 functions or operates as a conductive shielding projection that extends or projects upward from the ground termination pad. Since the ground termination pads 56 are positioned between pairs of signal terminations, the internal walls 101 are disposed between signal terminations 155 of adjacent pairs of signal terminations and operate to reduce EMI emissions and provide additional electrical isolation between signal termination pairs. The upper wall 96 may operate as an additional shielding structure to further reduce EMI emissions and shield the signal terminations 155 vertically to further isolate the signal terminations such as from the cables 150 that may pass over the signal terminations. Further, the U-shaped ground trace on the paddle card 30 substantially surrounds the signal termination pairs and, when electrically connected to the shield member 90, provides more complete shielding for the signal termination pairs.

The upper wall 96 may have a flat upper surface as depicted with respect to the shield members depicted at 90*a* or may have a tapered upper surface as depicted with respect to the shield members depicted at 90. The tapered upper surface may permit a reduction in size of the paddle card 30 by allowing the rows 50-52 of cable termination pads to be more closely spaced together.

In some embodiments, a shielding member 90 may be secured to each cable management member 70 after the cables 150 are mounted to the paddle card 30 and the signal conductors 151 terminated to the signal termination pads 55. The shielding members 90 may be secured to the cable management members 70 in any desired manner.

In the depicted embodiment, the front wall 73 of the cable management members 70 includes inward vertical slots 86 disposed or extending between adjacent openings 80 in the front wall. In addition, outward vertical slots 87 are disposed along the intersection between the front wall 73 and the sidewalls 75 of each cable management member 70. The rear wall 94 of the shielding member 90 includes a plurality of projections 105 with one projection extending rearwardly from each side wall 95 and one projection extending rearwardly from each internal wall 101. One of the projections 105 is configured to be aligned with and be received within the inward vertical slots 86 and the outward vertical slots 87. In the depicted embodiment, the projections 105 are mechanically connected to the inward vertical slots 86 and the outward vertical slots 87 to form an electrical connection between the cable management member 70 and the shield member 90.

Figure 26:
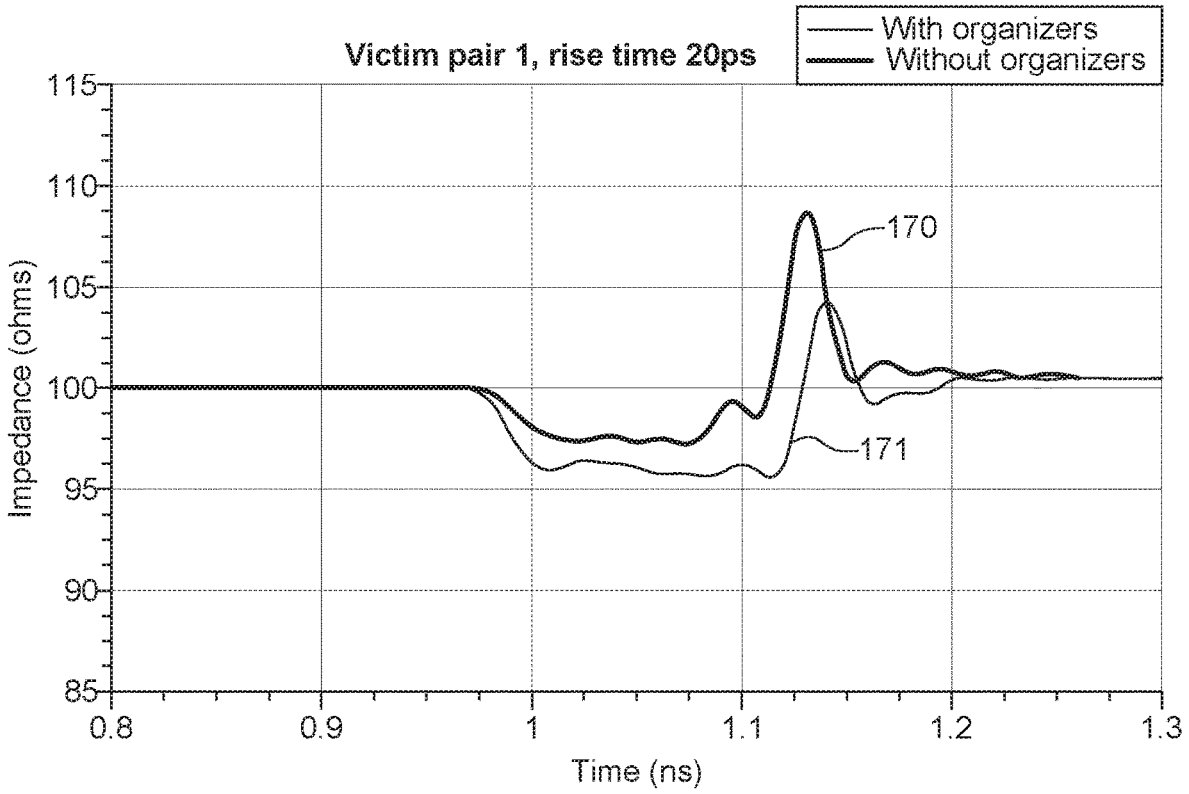
FIG. 26 is a graph of a simulation plotting impedance as a function of time with and without the cable management members and the shield members.

As described above, upon removing the shielding 153 from a cable 150 to expose the signal conductors 151, the impedance at the signal terminations 155 may be altered relative to the overall impedance of the transmission line. The impedance along the transmission line with the shielding 153 removed and without a cable management member 70 and shield member 90 is depicted by line 170 in FIG. 26. The impedance along the transmission line with the shielding 153 removed but with the system including a cable management member 70 and shield member 90 is depicted by line 171 in FIG. 26. Thus, it may be seen that the impedance discontinuity at the signal terminations 155 is decreased through the use of the cable management member 70 and shield member 90.

Referring to FIGS. 10-13, a combined cable management and shield member 120 is depicted as being mounted to the lower surface 32 of the paddle card 30. The combined cable management and shield member 120 includes a front end 121, a rear end 122, and sidewalls 123 that extend between the front end and the rear end. A lower or mounting surface 124 is configured for mounting adjacent the upper surface 31 of the paddle card 30 and an upper surface 125 faces in a direction opposite the mounting surface.

A central web 126 extends between the sidewalls 123 and is spaced from the front end 121. A rear web 127 extends between the sidewalls 124 adjacent the rear end 122. Each of the central web 126 and rear web 127 includes a plurality of arcuate cable receiving recesses 128 configured to receive a portion of the cables 150. One recess 128 from each of the central web 126 and the rear web 127 are axially aligned parallel to the mating axis 200. A plurality of elongated projections 129 extend forwardly from the central web 126 with a projection at each lateral side of each recess 128 in the central web.

The combined cable management and shield member 120 is similar to a combination of the cable management member 70 and shielding member 90 except that, as depicted, the combined cable management and shield member does not include structure to retain the cables 150 to the combined cable management and shield member and the combined cable management and shield member does not include structure to provide shielding over the signal terminations 155. In other words, while the combined cable management and shield member 120 will assist in positioning and aligning the cables 150, the cables are not threaded through openings in the combined cable management and shield member and therefore are not retained within the openings. Further, the elongated projections 129 operate as shielding projections disposed between adjacent signal terminations 155 but do not provide vertical shielding for the signal terminations. As will be appreciated, since the lower surface 32 of the paddle card 30 includes only one row 53 of cable terminations, cables 150 are not passing over the signal terminations 155 and thus the vertical shielding may not be necessary. Further, the combined cable management and shield member 120 has a lower profile and thus requires less vertical space.

In one embodiment, to assemble plug connector 10, the free ends of the cables 150 are generally or roughly cut to a desired length and inserted through the openings 80 in a pair of openings in the cable management members 70 from rear to front. The free ends of the cables 150 are positioned relative to the cable management member 70 and glued or otherwise secured to the cable management member. The ends of the cables 150 are then cut to the desired length and stripped or otherwise processed to expose the signal conductors 151.

A first cable management member 70, including the cables 150 mounted thereon, is positioned on the upper surface 31 of the paddle card 30 adjacent row 50 with the mounting projections 77 of the cable management members positioned within the mounting holes 67 of the paddle card. The first cable management member 70 is then secured to the paddle card 30 such as with rivets 78. The signal conductors 151 of each cable 150 are then terminated to the signal termination pads of row 50 such as by soldering. A first shield member 90 may then be secured to the first cable management member 70 with the shield member engaging the ground termination pads 56 on the paddle card 30. In one embodiment, the first cable management member 70 and the first shield member 90 may be secured together by a press or interference fit between the vertical slots 86, 87 and the projections 105.

Figure 21:
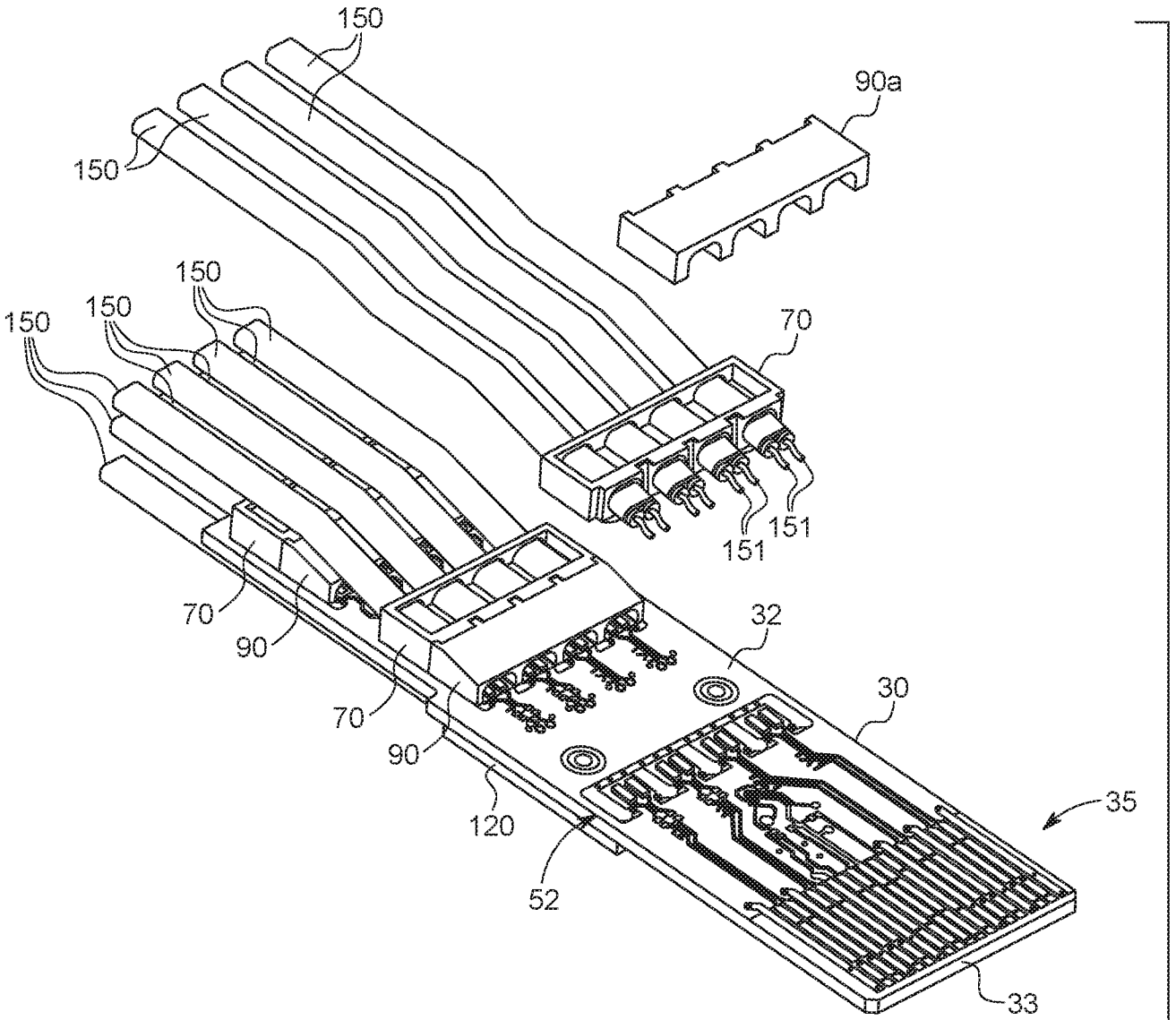
FIG. 21 is a perspective view of a paddle card, cables, cable management members, and shield members in a partially assembled state.
Figure 22:
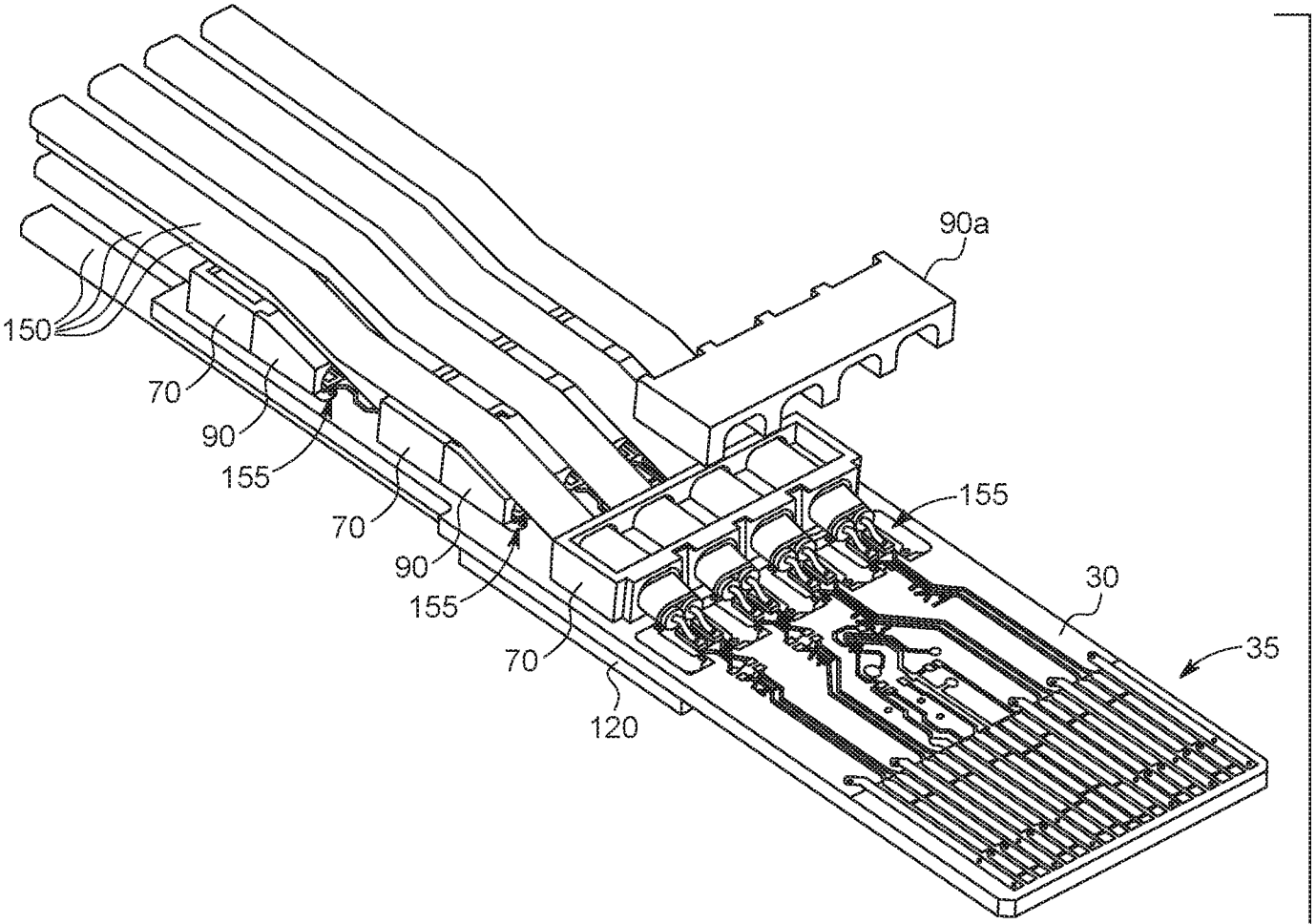
FIG. 22 is a perspective view of a paddle card, cables, cable management members, and shield members in a further partially assembled state.
Figure 23:
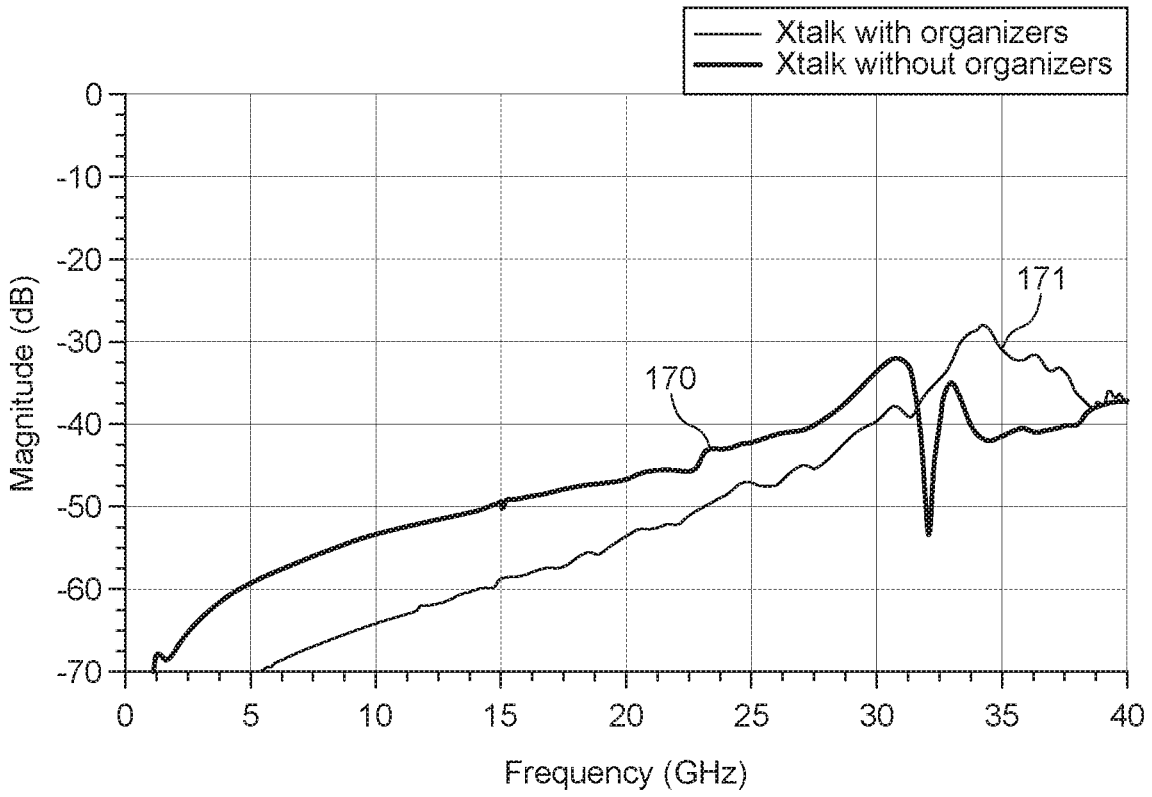
FIG. 23 is a graph of a simulation plotting crosstalk as a function of frequency with and without the cable management members and the shield members.
Figure 24:
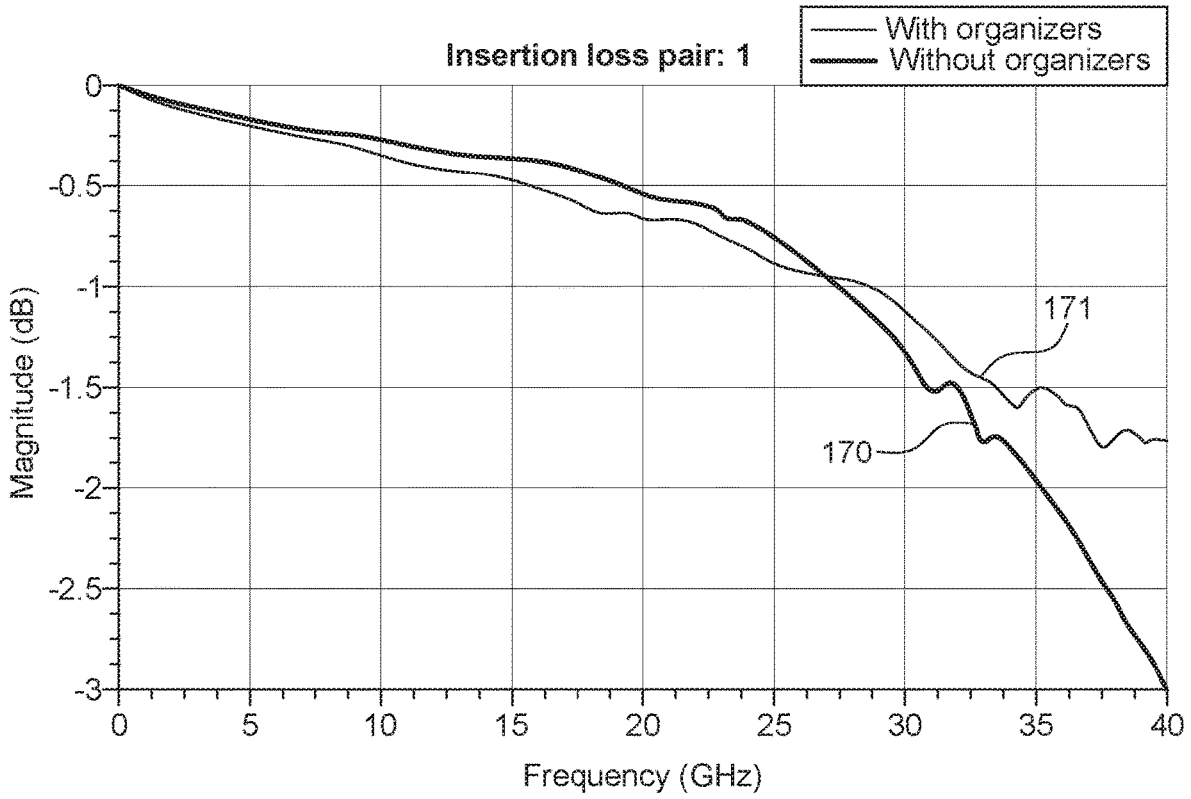
FIG. 24 is a graph of a simulation plotting insertion loss as a function of frequency with and without the cable management members and the shield members.
Figure 25:
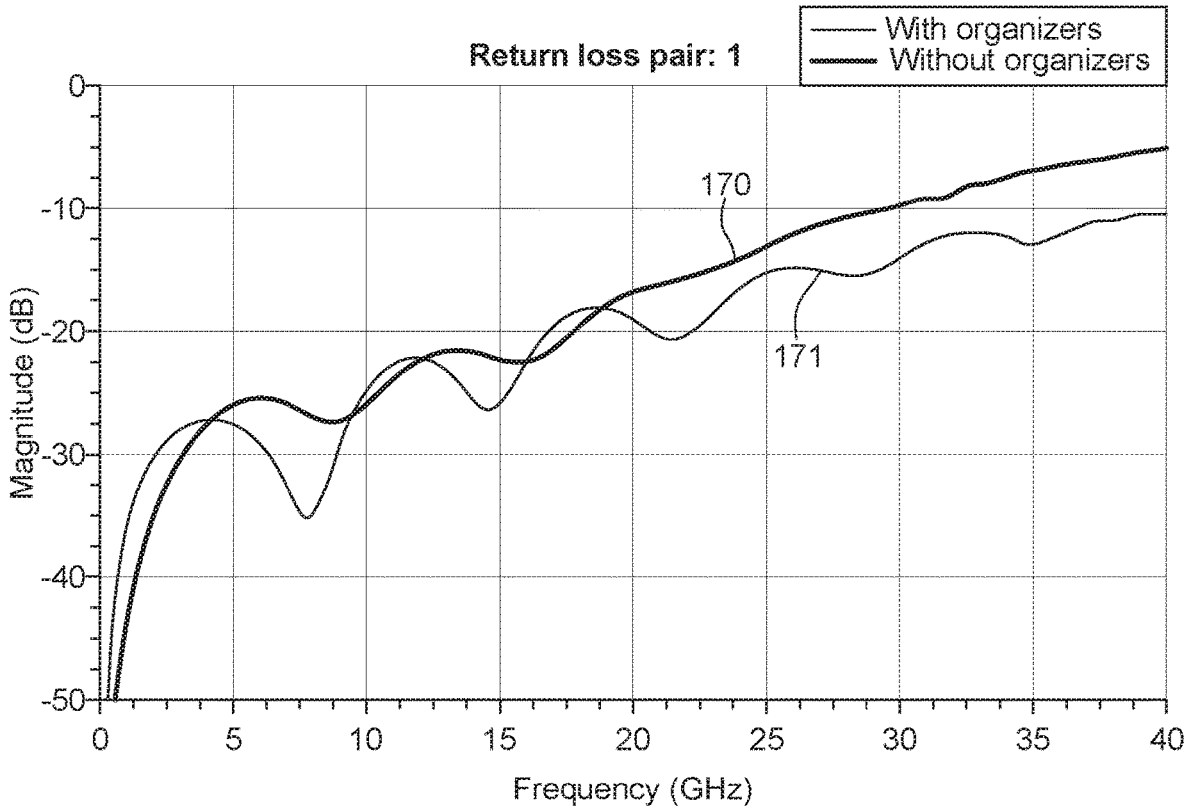
FIG. 25 is a graph of a simulation plotting return loss as a function of frequency with and without the cable management members and the shield members.

After mounting the first cable management member 70, terminating the signal conductors 101 to the first row 50 of termination pads and mounting the first shield member 90, a second cable management member 70 with cables 150 therein may also be mounted on the paddle card 30 adjacent the second row 51 of termination pads, the signal conductors 101 terminated to the signal pads 55 of the second row, and a second shield member 90 mounted to the second cable management member. Finally, a third cable management member 70 with cables 150 therein is mounted on the paddle card 30 adjacent the third row 52 of termination pads, the signal conductors 101 terminated to the signal pads 55 of the third row (FIG. 21), and a third shield member **90*a* mounted to the second cable management member (FIG. 22). Since no cables 150 are passing over the third shield member 90*a*, the third shield member may have a flat upper wall 96**.

Figure 4:
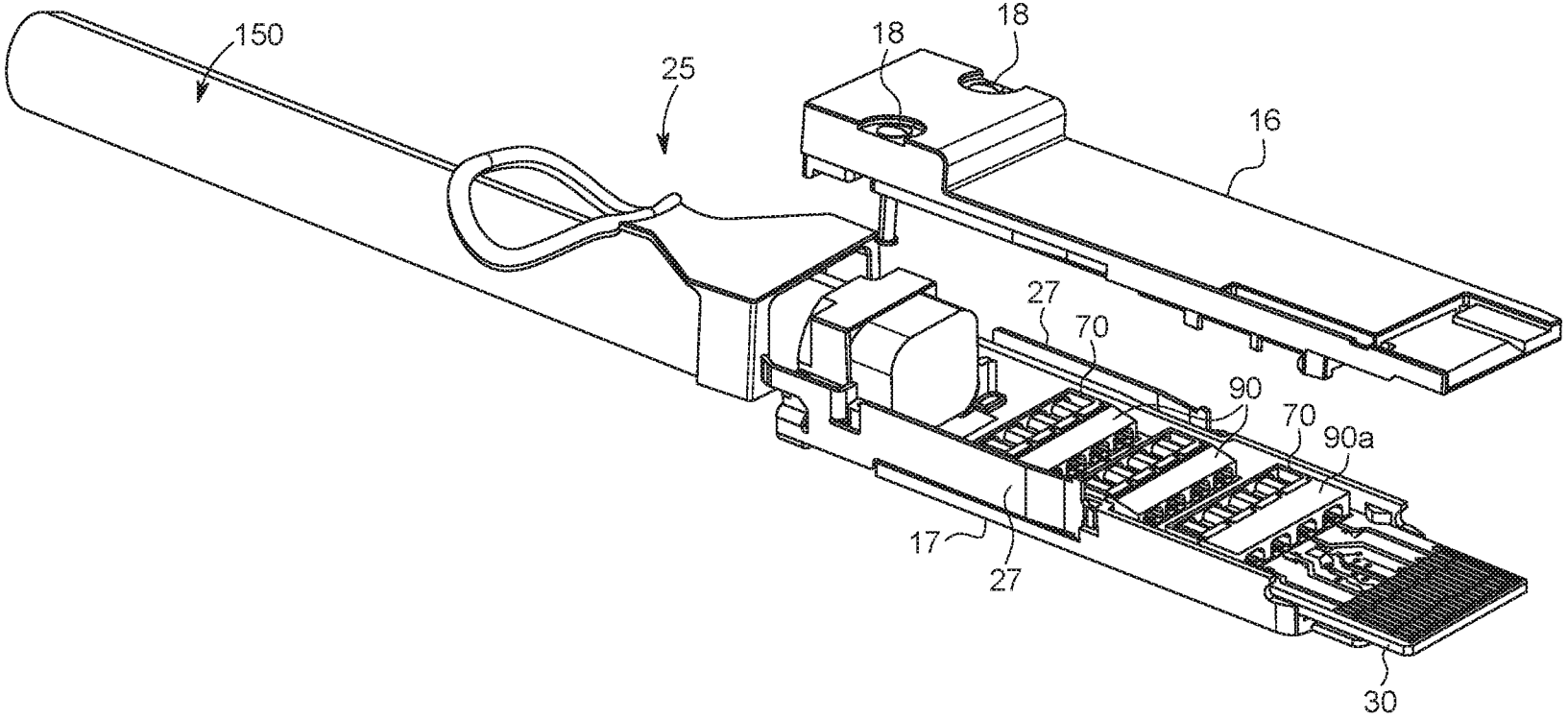
FIG. 4 illustrates a perspective view of the plug connector of FIG. 1 with the upper housing member exploded therefrom.
Figure 5:
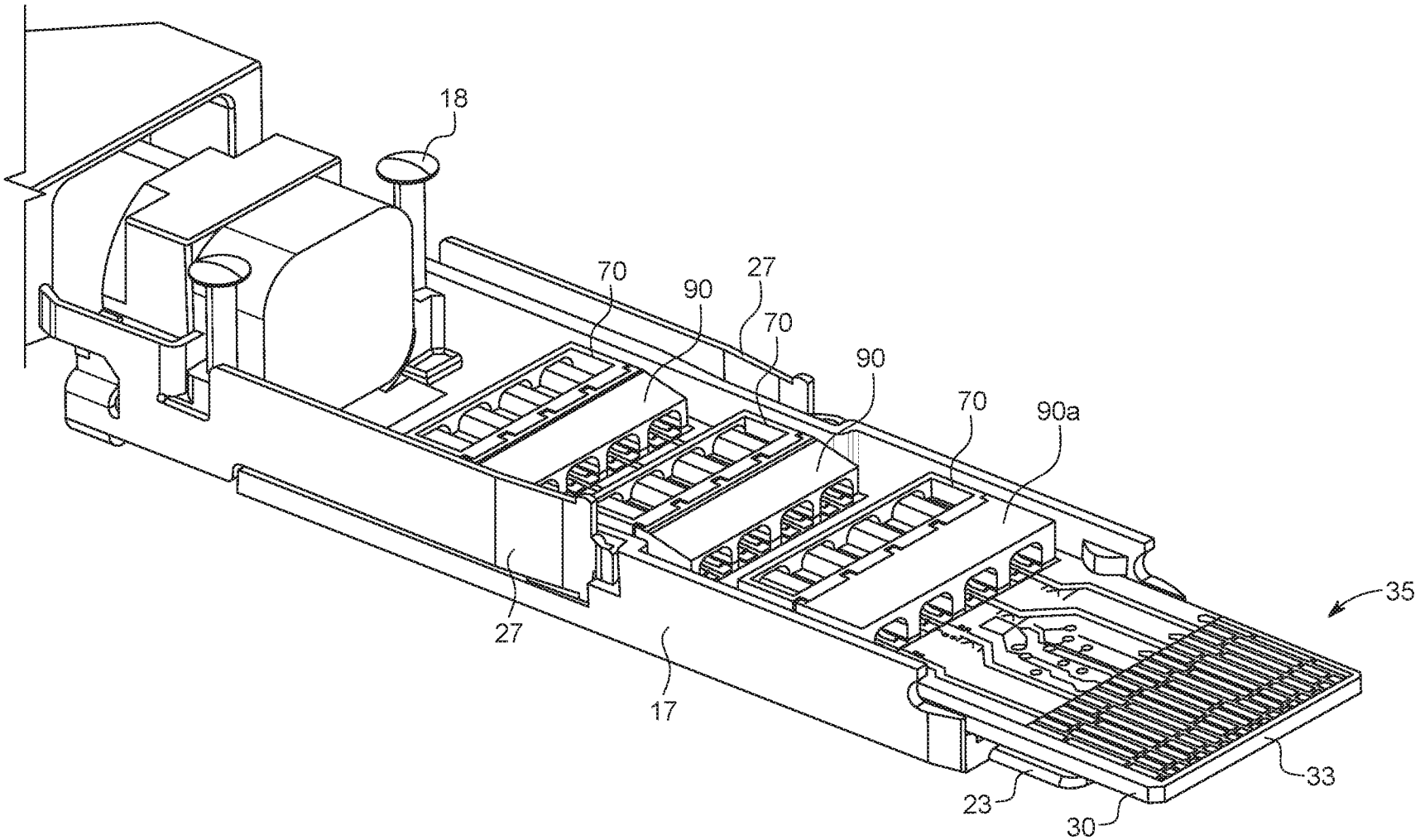
FIG. 5 illustrates an enlarged perspective view similar to FIG. 4 but without the upper housing member.
Figure 6:
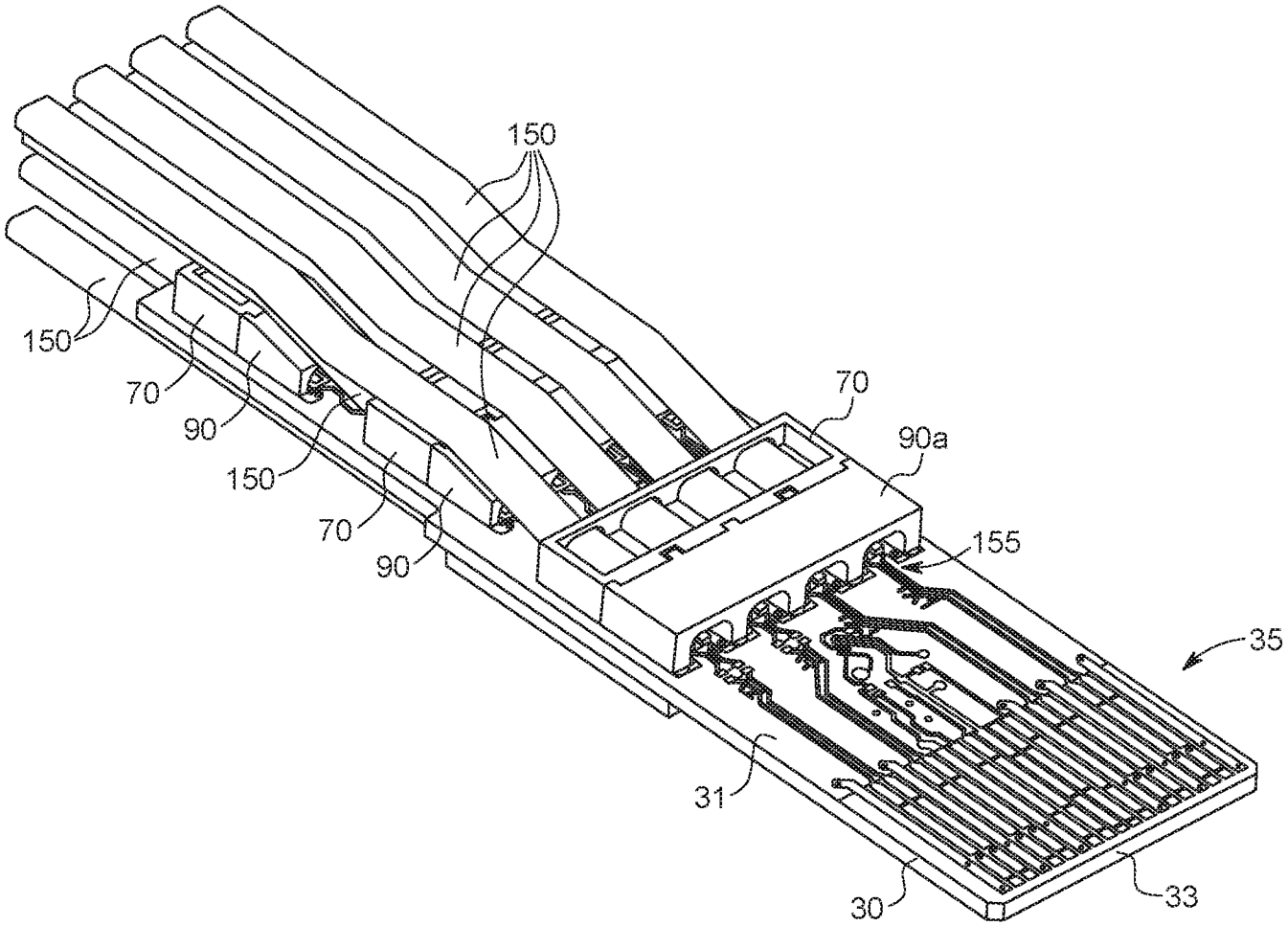
FIG. 6 illustrates a perspective view of a paddle card with a plurality of cables terminated thereto together with cable management members and shield members according to the disclosure.
Figure 7:
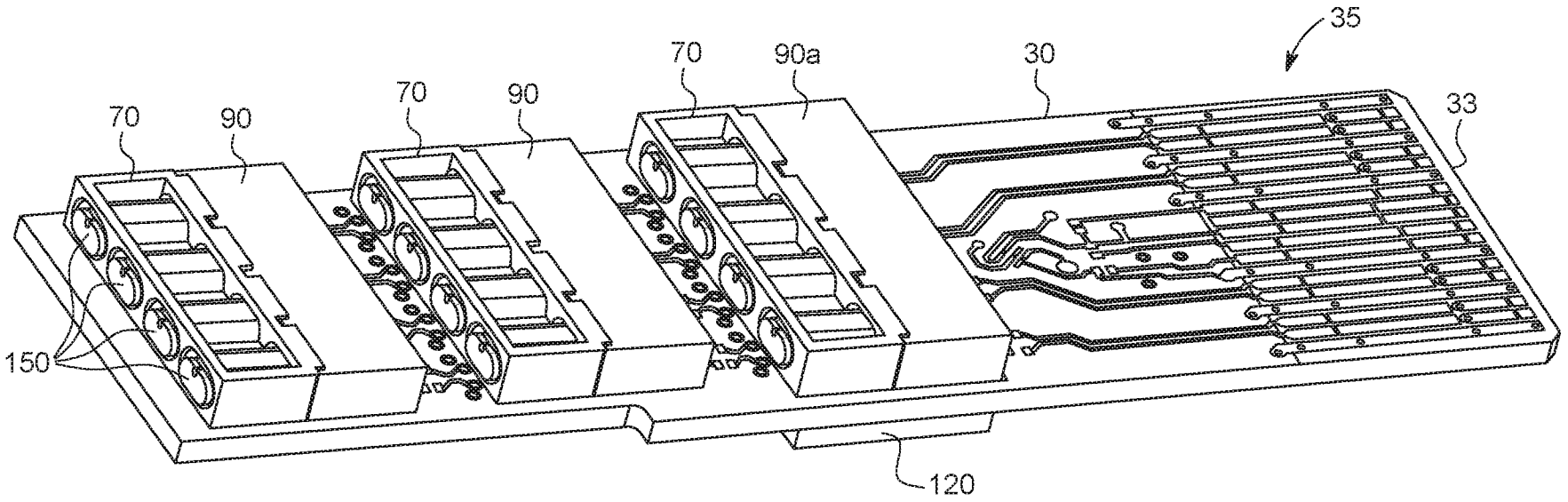
FIG. 7 illustrates a perspective view similar to FIG. 6 but with portions of the cables removed for clarity and with the components depicted from a different perspective.
Figure 8:
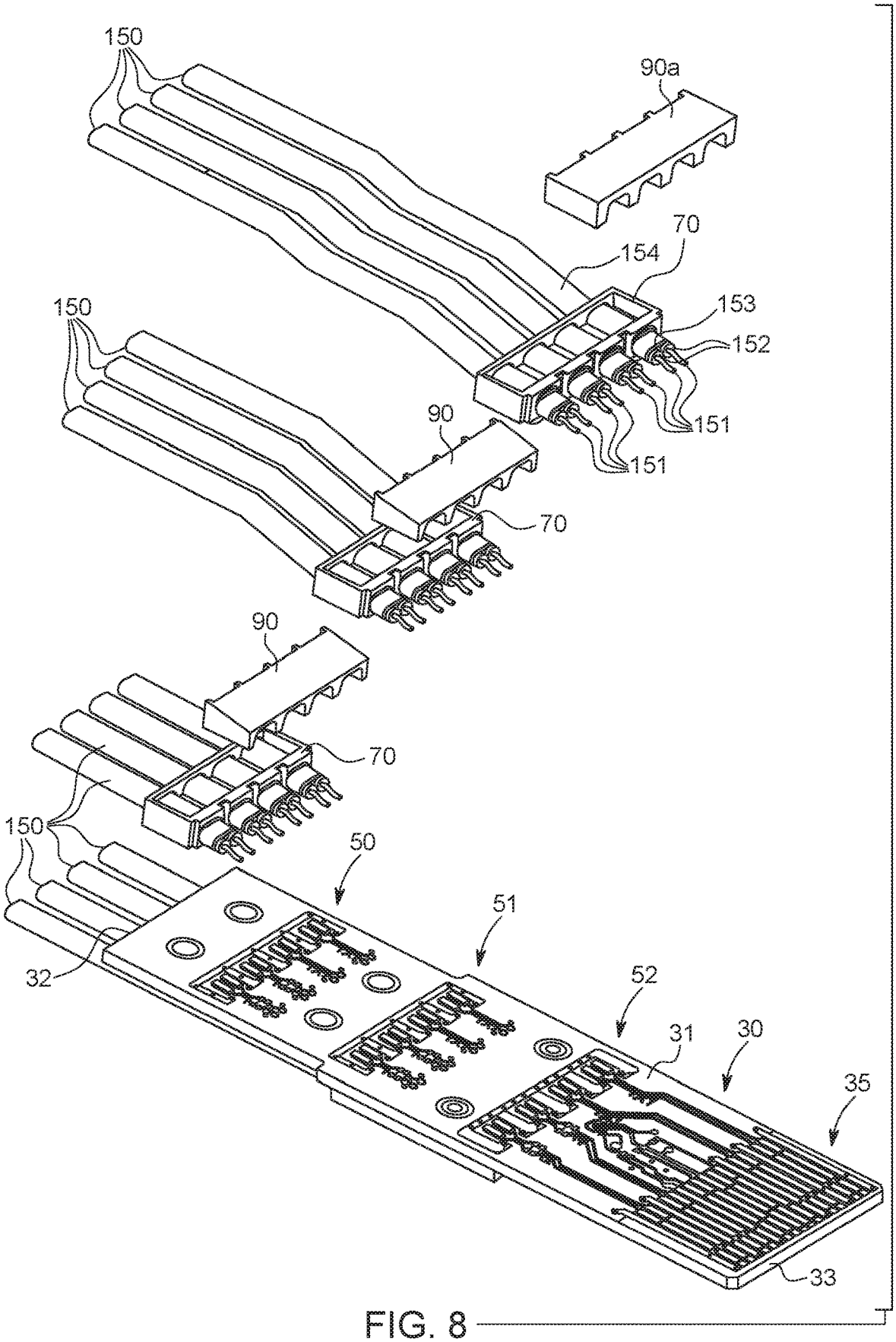
FIG. 8 illustrates a partially exploded perspective view of the paddle card, cables, cable management members, and shield members of FIG. 6.
Figure 9:
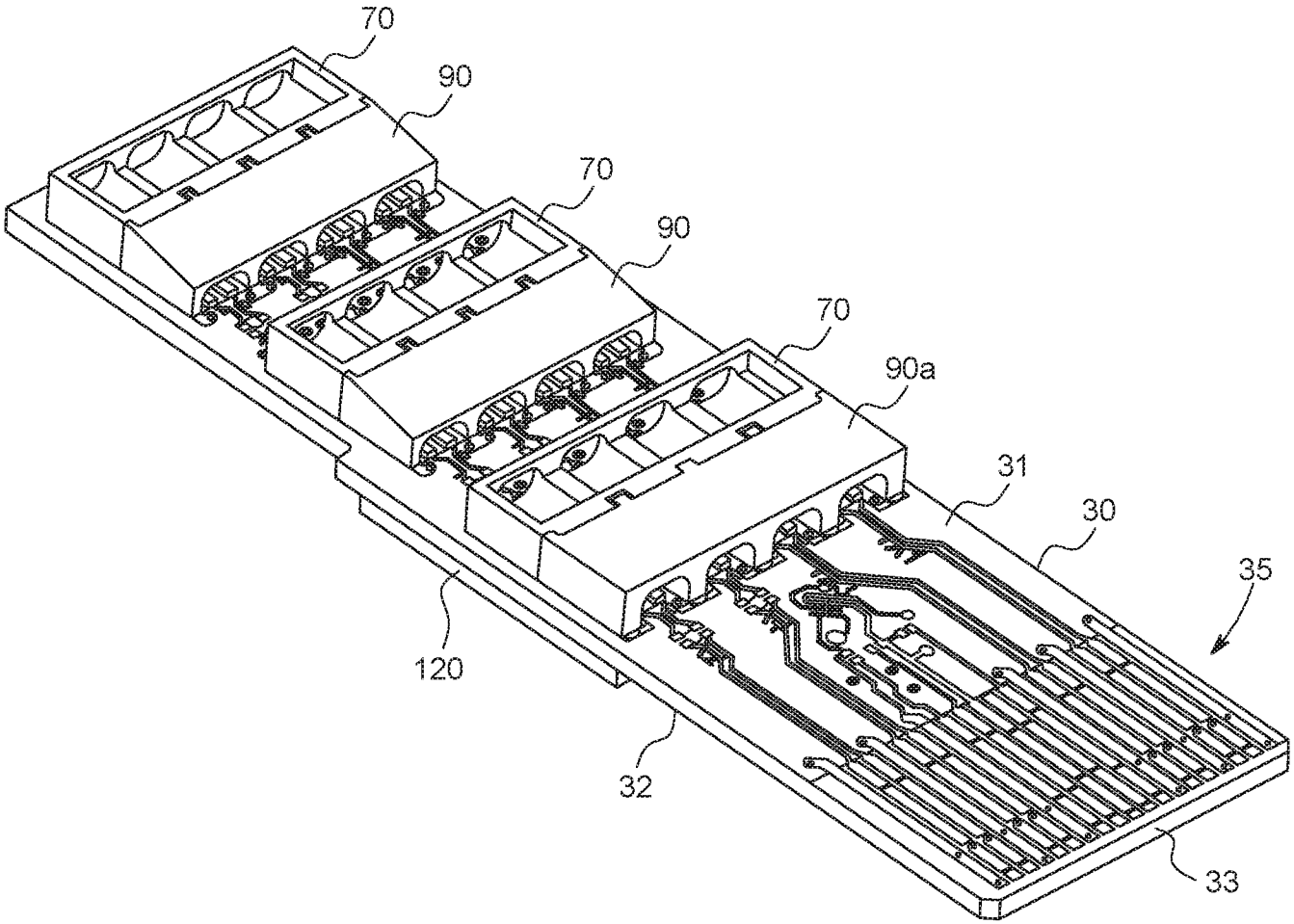
FIG. 9 illustrates a perspective view similar to FIG. 6 but with the cables removed for clarity.

While securing a cable management member 70 to the upper surface 31 of paddle card 30 adjacent to the row 52 of cable termination pads, the fasteners (e.g., rivets 78) used to secure the cable management member may also be used to secure the combined cable management and shield member 120 to the lower surface 32 of the paddle card. The free ends of the cables 150 may be generally or roughly cut to a desired length and the cables 150 positioned in a fixture similar to the combined cable management and shield member and secured together using an adhesive such as glue. The ends of the cables 150 are then cut to the desired length and stripped or otherwise processed to expose the signal conductors 151. The cables are then positioned within the recesses 128 of the central web 126 and the rear web 127 and glued or otherwise fixed in place relative to the combined cable management and shield member 120. The signal conductors 151 of each cable 150 are then terminated to the signal termination pads 55 such as by soldering. Once all of the cables 150 have been terminated to the paddle card 30, the paddle card with the cables terminated thereto may be positioned on the lower housing component 17 as depicted in FIG. 4 and the upper housing component 16 secured to the lower housing component.

As is known, the cables 150, which are sometimes referred to as twinax cables, typically have an outer shield 153. If an outer shield 153 is provided, the cable management member 70 can capacitively couple to the shields and can act as a ground for AC currents. Thus, a direct electrical connection is not required to provide a path to ground. In certain applications, however, there may be a desire for a direct electrical connection between the shields 153 of the cables 150 and cable management member 70 and, in those situations, the shields 153 can be connected directly to the cable management member 70.

If desired, the cable 150 can also include a drain wire 156 (FIG. 16). In one embodiment, the drain wire 156 can be capacitively coupled to the cable management member 70 without a direct electrical connection. In order to provide sufficient capacitive coupling, the cable management member 70 can be configured so as to have a sufficient conductive surface area adjacent the drain wire 156. Alternatively, the drain wire 156 can also be directly connected to the cable management member 70 or the shield member 90. In a further embodiment, the drain wire 156 may be terminated directly to the ground structure (e.g., ground termination pads 56 and bridging member 57) on the paddle card 30.

In FIGS. 23-26, transmission lines utilizing both the cable management member 70 and shield member 90 are depicted by lines 171 while transmission lines without the cable management member and the shield member are depicted by lines 170. As can be appreciated, electrical performance is similar or better with the cable management member 70 and shield member 90 as compared to conventional designs (about 0.1 dB worse in insertion loss while provide noticeable improvements in return loss at higher frequencies) with the most significant improvement being in crosstalk performance. These improvements are expected to be helpful for applications where the decreased crosstalk provides additional channel margin.

It should be noted that in some applications, the paddle card 30 may be configured with both the cable management member 70 and shield member 90 at each row 50-52 of cable termination pads, with only one of cable management member 70 and shield member 90 at each row 50-52 of cable termination pads, or without any of cable management member 70 and shield member 90 at each row 50-52 of cable termination pads. However, in applications in which relatively large signal conductors (28 gauge or larger) are used to support speeds of 10 GHz or higher, multiple rows 50-52 of cable termination pads are provided with some of the cables 150 passing over rows of cable termination pads. As a result, utilizing both cable management members 70 and shield members 90 at each row 50-52 of cable termination pads assists in achieving the desired electrical performance (e.g., high speed data transmission without significant losses).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A plug assembly comprising:

a housing, the housing being configured for mating along a mating axis, the housing having a first mating end and a second end opposite the first mating end, an upper housing component comprising an upper cantilevered section extending towards and reaching the first mating end and a lower housing component comprising a lower cantilevered section extending towards the first mating end and wherein the upper cantilevered section is separately cantilevered from the lower cantilever section and is longer than the lower cantilevered section;

a paddle card mounted in the housing, the paddle card having a first side and a second side opposite the first side, a first mating end and a second end opposite the first mating end, the paddle card including a plurality of conductive mating pads adjacent the first mating end of the paddle card, and a plurality of cable termination pads, the plurality of cable termination pads being configured in a first set of rows on the first side of the paddle card and only a single row on the second side of the paddle card, the cable termination pads of each row including signal termination pads and ground termination pads, wherein a first number of rows of cable termination pads on the first side is at least double a second number of rows of cable termination pads on the second side; and a plurality of cables in the housing including a first cable and a second cable, each cable including a signal conductor, wherein at least one signal conductor of the first cable is terminated to a row on the first side of the paddle card and at least one signal conductor of the second cable is terminated to a row on the second side of the paddle card.

2. The plug assembly of claim 1, wherein the mating pads are configured in a plurality of pairs, each pair being parallel to the mating axis.

3. The plug assembly of claim 1, wherein the paddle card includes a first row of cable termination pads along the first side adjacent the second end of the paddle card, and at least one additional row of cable termination pads spaced from the first row of cable termination pads and spaced from the mating pads, the first row of cable termination pads and the additional row of cable termination pads comprising signal termination pads and ground termination pads, a signal conductor of each of a plurality of first cables being terminated to each of the signal termination pads of the first row to define a first signal termination and a signal conductor of each of a plurality of additional cables being terminated to each of the signal termination pads of the additional row.

4. The plug assembly of claim 3, wherein a portion of each additional cable extends over one of the first signal terminations.

5. The plug assembly of claim 4, further comprising a conductive shielding structure between each first signal termination and an adjacent additional cable.

6. The plug assembly of claim 5, wherein each conductive shielding structure is mechanically connected to one of the ground termination pads of the first row of cable termination pads.

7. A method of assembling a plug connector, comprising:

a) providing a housing, the housing being configured for mating along a mating axis, the housing having a first mating end and a second end opposite the first mating end, an upper housing component comprising an upper cantilevered section extending towards and reaching the first mating end and a lower housing component comprising a lower cantilevered section extending towards the first mating end and wherein the upper cantilevered section is separately cantilevered from the lower cantilever section and is longer than the lower cantilevered section;

b) providing a paddle card, the paddle card having a first side, a first mating end and a second end opposite the first mating end, the paddle card including a plurality of conductive mating pads adjacent the first mating end of the paddle card, and a plurality of cable termination pads, the plurality of cable termination pads being configured in a first row of cable termination pads along the first side adjacent the second end, and at least one additional row of cable termination pads spaced from the first row of cable termination pads and spaced from the mating pads, the first row of cable termination pads and the additional row of cable termination pads comprising signal termination pads and ground termination pads;

c) providing a plurality of cables in the housing, each cable including a signal conductor;

d) terminating each signal conductor of a first set of the cables to one of the signal termination pads of the first row of cable termination pads to define a first signal termination;

e) mounting a first shield member on the paddle card including mounting a conductive first shielding projection between adjacent first signal terminations and electrically connecting each first shielding projection to one of the ground termination pads of the first row;

f) after completing steps d) and e), terminating each signal conductor of a second set of the cables to one of the signal termination pads of the second row of cable termination pads to define a second signal termination;

g) mounting a second shield member on the paddle card including mounting a conductive second shielding projection between adjacent second signal terminations and electrically connecting each second shielding projection to one of the ground termination pads of the second row;

h) mounting the paddle card and cables within the housing.

8. The method of claim 7, further comprising mounting the first set of cables on a first cable management member and stripping the cables to expose the signal conductors prior to step d).

9. The method of claim 8, further comprising mounting the second set of cables on a second cable management member and stripping the cables to expose the signal conductors prior to step f).

10. The method of claim 8, further comprising mounting the first cable management member on the paddle card prior to step d).

11. The method of claim 10, further comprising mounting a second cable management member on the paddle card prior to step f).

12. A plug assembly comprising:

a housing, the housing being configured for mating along a mating axis, the housing having a first mating end and a second end opposite the first mating end, an upper housing component comprising an upper cantilevered section extending towards and reaching the first mating end and a lower housing component comprising a lower cantilevered section extending towards the first mating end and wherein the upper cantilevered section is separately cantilevered from the lower cantilever section and is longer than the lower cantilevered section;

a paddle card mounted in the housing, the paddle card having a first side and a second side opposite the first side, a first mating end and a second end opposite the first mating end, the paddle card including a plurality of conductive mating pads adjacent the first mating end of the paddle card, a plurality of cable termination pads disposed in a row on the first side of the paddle card and in a row on the second side of the paddle card, each row of cable termination pads including signal termination pads and ground termination pads;

a plurality of cables in the housing including a first cable and a second cable, each cable including a signal conductor, wherein at least one signal conductor of the first cable is terminated to a signal termination pad on a row on the first side of the paddle card and at least one signal conductor of the second cable is terminated to a signal termination pad on a row on the second side of the paddle card to define signal terminations; and a plurality of conductive shielding projections disposed on the paddle card, each shielding projection being disposed between adjacent signal terminations and being electrically connected to one of the ground termination pads.

13. The plug assembly of claim 12, further comprising a shielding member, the shielding member including a body and the plurality of shielding projections.

14. The plug assembly of claim 12, wherein each shielding projection is mechanically connected to one of the ground termination pads.

15. The plug assembly of claim 12, wherein the row of cable termination pads is perpendicular to the mating axis.

16. The plug assembly of claim 12, the mating pads are configured in a plurality of pairs, each pair being parallel to the mating axis.

17. The plug assembly of claim 13, wherein the plurality of shielding projections are integrally formed with the body.

18. The plug assembly of claim 17, wherein the body further includes a base interconnecting the shielding projections, the base being spaced from the paddle card and the shielding projections extending between the paddle card and the base.

19. The plug assembly of claim 17, wherein the body further includes a base interconnecting the shielding projections, the base being adjacent the paddle card, the shielding projections extending from the base.

20. The plug assembly of claim 18, wherein the shielding projections and the base define a plurality of U-shaped openings.

21. The plug assembly of claim 18, wherein the base includes conductive shielding over each signal termination.

22. The plug assembly of claim 21, wherein the paddle card includes a first row of cable termination pads adjacent the second end of the paddle card, and at least one additional row of cable termination pads spaced from the first row of cable termination pads and spaced from the mating pads, the first row of cable termination pads and the additional row of cable termination pads comprising signal termination pads and ground termination pads, a signal conductor of each of a plurality of first cables being terminated to each of the signal termination pads of the first row to define a first signal termination and a signal conductor of each of a plurality of additional cables being terminated to each of the signal termination pads of the additional row, wherein a portion of each additional cable extends over one of the first signal terminations and the conductive shielding of the base is disposed between each first signal termination and an adjacent additional cable.

23. A plug assembly comprising:

a housing, the housing being configured for mating along a mating axis, the housing having a first mating end and a second end opposite the first mating end, an upper housing component comprising an upper cantilevered section extending towards and reaching the first mating end and a lower housing component comprising a lower cantilevered section extending towards the first mating end and wherein the upper cantilevered section is separately cantilevered from the lower cantilever section and is longer than the lower cantilevered section;

a paddle card mounted in the housing, the paddle card having a first side and a second side opposite the first side, a first mating end and a second end opposite the first mating end, the paddle card including a plurality of conductive mating pads adjacent the first mating end of the paddle card, a plurality of cable termination pads disposed in a plurality of rows on the first side of the paddle card and in a second side row on the second side of the paddle card, the cable termination pads including signal termination pads and ground termination pads;

a plurality of cables in the housing including a first cable and a second cable, each cable including a signal conductor, wherein at least one signal conductor of the first cable is terminated to a signal termination pad on a row on the first side of the paddle card and at least one signal conductor of the second cable is terminated to a signal termination pad on a row on the second side of the paddle card defining signal terminations; and a cable management member disposed on the paddle card adjacent the cable termination pads of at least one of the plurality of rows, the cable management member including a plurality of openings with one of the cables disposed in each opening.

24. The plug assembly of claim 23, wherein each opening is a bore and each cable extends through a pair of bores in the cable management member.

25. The plug assembly of claim 24, wherein the bores of each pair are aligned along an axis parallel to the mating axis.

26. The plug assembly of claim 23, wherein the ground termination pads are positioned between pairs of signal termination pads, and further comprising a shielding member secured to the cable management member, the shielding member comprising a plurality of shielding projections, each shielding projection being disposed between adjacent signal terminations and being electrically connected to one of the ground termination pads.

27. The plug assembly of claim 26, wherein the shielding member further includes a base interconnecting the shielding projections, the base being spaced from the paddle card and the shielding projections extending between the paddle card and the base and the base includes conductive shielding over each cable termination.

28. The plug assembly of claim 23, wherein the paddle card includes a first row of cable termination pads adjacent the second end of the paddle card, and at least one additional row of cable termination pads spaced from the first row of cable termination pads and spaced from the mating pads, the first row of cable termination pads and the additional row of cable termination pads comprising signal termination pads and ground termination pads, a signal conductor of each of a plurality of first cables being terminated to each of the signal termination pads of the first row to define a first signal termination and a signal conductor of each of a plurality of additional cables being terminated to each of the signal termination pads of the additional row, wherein a portion of each additional cable extends over one of the first signal terminations and the conductive shielding of the base is disposed between each first signal termination and an adjacent additional cable.

29. The plug assembly of claim 23, wherein the cable management member further includes a plurality of conductive shielding projections, each shielding projection being disposed between adjacent signal terminations and being electrically connected to one of the ground termination pads.

30. The plug assembly of claim 29, wherein the cable management member comprises a first section including the openings for securing each cable to the paddle card and a second section configured as the shielding projections.

31. The plug assembly of claim 23, the mating pads are configured in a plurality of pairs, each pair being parallel to the mating axis.

* * * * *